US008267399B2

(12) United States Patent
Kushida et al.

(10) Patent No.: US 8,267,399 B2
(45) Date of Patent: Sep. 18, 2012

(54) SHEET PROCESSING APPARATUS AND IMAGE FORMING APPARATUS INCLUDING SAME

(75) Inventors: Hideki Kushida, Moriya (JP); Yusuke Obuchi, Abiko (JP); Toshiyuki Iwata, Toride (JP); Rikiya Takemasa, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/960,360

(22) Filed: Dec. 3, 2010

(65) Prior Publication Data

US 2011/0133392 A1 Jun. 9, 2011

(30) Foreign Application Priority Data

Dec. 8, 2009 (WO) ..... PCT/JP2009/070572
Feb. 19, 2010 (WO) ..... PCT/JP2010/052560

(51) Int. Cl.
*B65H 39/00* (2006.01)

(52) U.S. Cl. ..... 271/233; 271/3.02; 271/81; 270/58.12; 270/58.27

(58) Field of Classification Search ..... 271/3.02, 271/286, 226, 233, 314, 81; 270/58.11, 58.12, 270/58.27, 58.01, 58.08, 58.17
See application file for complete search history.

(56) References Cited

U.S. PATENT DOCUMENTS 6,241,234 B1 * 6/2001 Saitoh et al. ..... 270/58.12
7,354,036 B2 * 4/2008 Hayashi et al. ..... 270/58.12
7,431,288 B2 * 10/2008 Shmaiser et al. ..... 271/186
7,810,801 B2 * 10/2010 Stemmer ..... 271/105
8,123,209 B2 * 2/2012 Kubota et al. ..... 270/58.07

FOREIGN PATENT DOCUMENTS

JP 60-236969 A 11/1985
JP 11-322165 A 11/1999
JP 2002-037512 A 2/2002
JP 2002-187663 A 7/2002
JP 2003-300658 A 10/2003

* cited by examiner

*Primary Examiner* — Jeremy R Severson

(74) *Attorney, Agent, or Firm* — Canon USA Inc. IP Division

(57) ABSTRACT

A sheet processing apparatus capable of improving sheet processing performance and productivity is provided. While sheets are conveyed in a piled state toward a rear-end stopper, displacement is produced between the sheets by a pair of discharge rollers. Even if adhesion occurs between the sheets during conveyance thereof, the adhesion between the sheets can be removed before the sheets come into contact with the rear-end stopper.

3 Claims, 20 Drawing Sheets

SHEET PROCESSING APPARATUS AND IMAGE FORMING APPARATUS INCLUDING SAME

BACKGROUND OF THE INVENTION

1. Field of the Invention

The present invention relates to a sheet processing apparatus that performs sheet processing on a sheet conveyed onto a tray and to an image forming apparatus including the same and, in particular, to one having a buffering mechanism that temporarily buffers a sheet.

2. Description of the Related Art

In recent years, some image forming apparatuses, such as copiers, printers, and facsimile machines, can perform additional processing on a sheet with an image formed thereon by use of sheet processing apparatuses that are connected in a sheet conveying direction and that perform sheet processing, such as binding, punching, and sorting, on a sheet with an image formed thereon. To perform sheet processing requiring a long processing time, for example, binding processing, a sheet processing apparatus described above temporarily stores (hereinafter referred to as buffers) a succeeding sheet conveyed from the image forming apparatus during the processing of a preceding sheet bundle in order to avoid reduction in productivity. A processing time required for the sheet processing can be obtained by buffering a necessary number of succeeding sheets for obtaining the processing time for the preceding sheet bundle and causing a sheet processing portion to convey the buffered sheets in a piled state after the preceding sheet bundle is discharged. In such a way, while sheet processing is performed on a preceding sheet bundle, succeeding sheets are buffered by a buffering mechanism, and thus during that sheet processing, an image forming operation in an image forming apparatus is not stopped, thereby improving manufacturing capability in the entire system.

An example sheet processing apparatus having a buffering mechanism is the one in which succeeding sheets conveyed during sheet processing of a preceding sheet bundle on a processing tray are buffered in a buffer path and the succeeding sheets are discharged to the processing tray after the sheet processing (see Japanese Patent Laid-Open No. 11-322165). With this, even if sort processing is performed on a processing tray, for example, there is no need to stop an image forming operation in an image forming apparatus, so a processing time for executing a job containing sheet processing in the entire system is shortened.

There is also an apparatus that includes a sheet property detection portion for detecting a sheet property and prohibits a buffering operation of conveying a plurality of sheets in a piled state when the sheet property detection portion has detected that a conveyed sheet has a property different from that of a normal sheet (see Japanese Patent Laid-Open No. 2003-300658). This deals with a situation in which, in a traditional buffering operation, although it is difficult to pile sheets without misalignment and thus aligning the sheets again on a processing tray is necessary, depending on a sheet shape or a sheet property, such as a sheet surface nature, it may be difficult to collectively align a bundle in which sheets are piled.

For example, data on adhesion forces acting between sheets having different surface natures, like plain paper and (five types of) coated paper having coated surfaces, is illustrated in FIG. 20. These adhesion forces indicate forces required to, after sheets are conveyed in a piled state, displace the piled sheets in a sheet conveying direction to separate them. FIG. 20 reveals that adhesion forces of coated paper are significantly larger than that of plain paper. It is difficult to collectively align a bundle of sheets adhering to each other with such a large adhesion force on a processing tray. Therefore, for a traditional sheet processing apparatus, it is an object to achieve both stable conveyance and processing and improved efficiency of sheet processing of an entire system by determining whether a buffering operation is necessary by the property of a sheet conveyed to a processing tray and switching control in response to the determination.

However, for a sheet processing apparatus that determines the necessity or non-necessity of a buffering operation in accordance with the sheet property, running with reduced productivity of the entire system may be required depending on the property of a conveyed sheet, and this causes a decrease in performance. In particular, in recent years, there are situations where the variety of sheets that copiers and printers can use has increased, the number of sheets output per unit time has increased, and efforts to address environmental issues, for example, energy conservation, are advancing year by year. Under the circumstances, issues caused by being unable to perform buffering, such as a decrease in performance of an entire system and an increase in power consumption resulting from an increase in operation time, are becoming noticeable. Thus, irrespective of a sheet type, high throughput and high processing efficiency as much as possible are increasingly desired.

Accordingly, it is an object of the present invention to provide a sheet processing apparatus that reduces adhesion of sheets being conveyed in a piled state even when the sheets are coated paper having good surface nature or film sheets, such as overhead transparency (OHT) sheets, and that achieves satisfactory alignment of the sheets on a processing tray.

SUMMARY OF INVENTION

The present invention provides a sheet processing apparatus including a conveying portion capable of conveying a plurality of sheets in a piled state, a stacking tray on which sheets, conveyed by the conveying portion, are stacked, and a regulation member against which a sheet is abutted to regulate the sheet conveyed to the stacking tray. The conveying portion causes displacement to occur in the piled sheets in a sheet conveying direction before the piled sheets are abutted against the regulation member.

Further features of the present invention will become apparent from the following description of exemplary embodiments with reference to the attached drawings.

DESCRIPTION OF EMBODIMENTS

First Embodiment

Embodiments for carrying out the invention are described in detail below using the drawings.

Image Forming Apparatus

Figure 1:
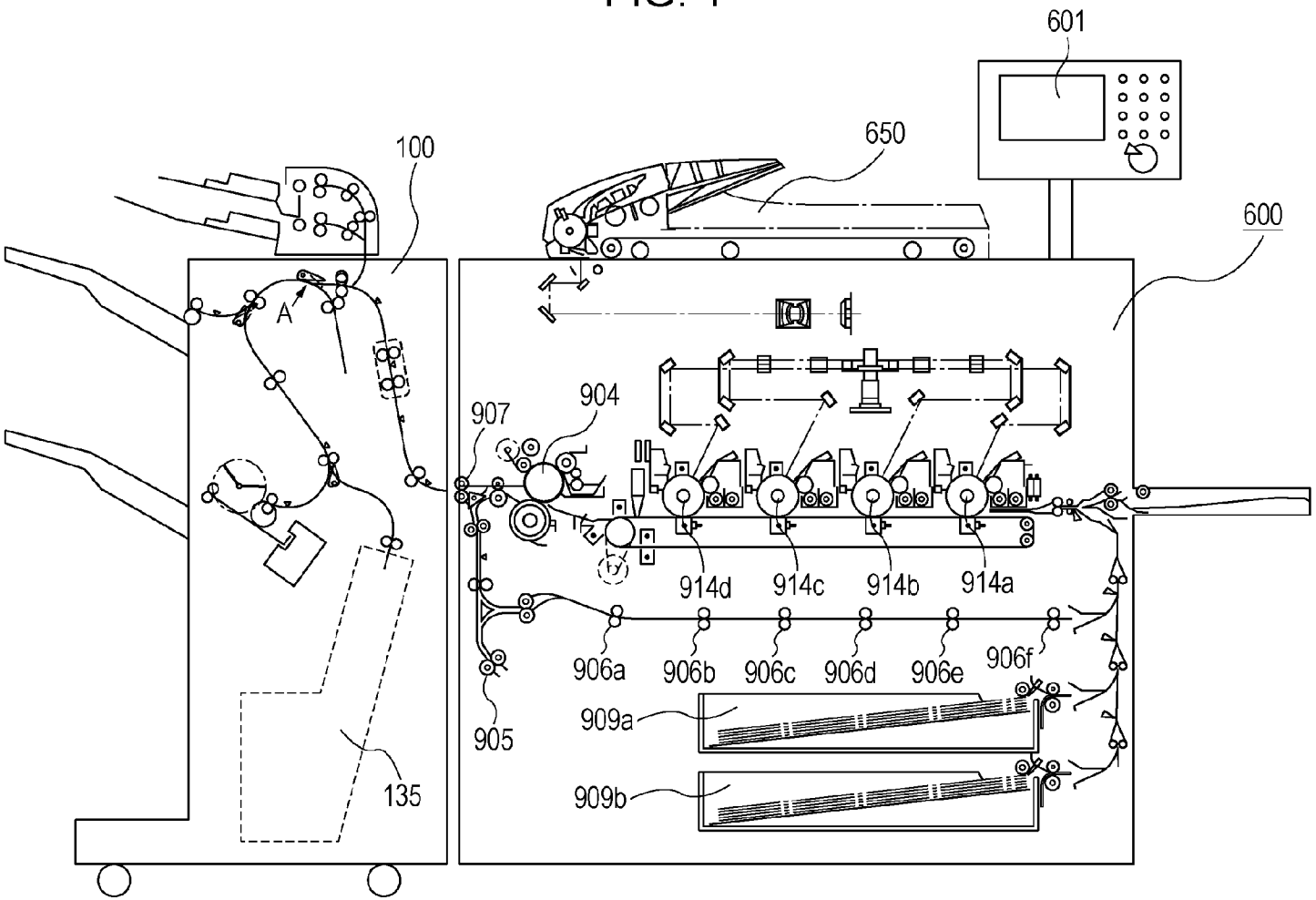
FIG. 1 is a diagram of an image forming apparatus and a sheet processing apparatus according to the present embodiment.

FIG. 1 is a diagram of an image forming apparatus and a sheet processing apparatus. The image forming apparatus illustrated in FIG. 1 includes an image forming apparatus main body 600 for forming monochrome and color images and a sheet processing apparatus (hereinafter referred to as finisher) 100. The finisher 100 is on-line connected to the image forming apparatus main body 600 and performs processing on a sheet discharged from the image forming apparatus main body 600. The image forming apparatus main body 600 can also be used solely without connecting its discharge port to the finisher 100. The image forming apparatus main body 600 can integrate the finisher 100 as a sheet discharging device.

Here, a location where a user faces an operation section 601 to input or set various kinds of information into the image forming apparatus main body 600 is referred to as a frontal front side (hereinafter, front side) of the image forming apparatus, and an apparatus rear side is referred to as a back side. FIG. 1 illustrates a configuration of the image forming apparatus seen from the apparatus front side. The finisher 100 is connected to a lateral portion of the image forming apparatus main body 600.

Four-color toner images are transferred in a superimposing manner to a sheet S supplied from a cassette 909*a* or 909*b* in the image forming apparatus main body 600 by yellow, magenta, cyan, and black photosensitive drums 914*a* to 914*d* forming an image forming portion. Then the toner images on the conveyed sheet are fixed by a fixing unit 904; in single-sided image forming mode, the sheet S is directly discharged to the outside of the apparatus main body through a pair of discharge rollers 907, and in duplex image forming mode, the sheet S is delivered from the fixing unit 904 to a reversing roller 905, which is reversed at the timing when the upstream end (rear end) of the sheet S in a sheet conveying direction exceeds a switching portion P, and the sheets S is thus conveyed to duplex conveying rollers 906*a* to 906*f*. The sheet S is conveyed to the image forming portion again, four-color toner images are transferred in a superimposing manner to the back side of the sheet S by the yellow, magenta, cyan, and black photosensitive drums 914*a* to 914*d*. The sheet S with the toner images transferred on its back side is moved to the fixing unit 904, and the toner images are fixed by the fixing unit 904. Then the sheet S is discharged to the outside of the apparatus main body through the pair of discharge rollers 907.

Control Section

Figure 2:
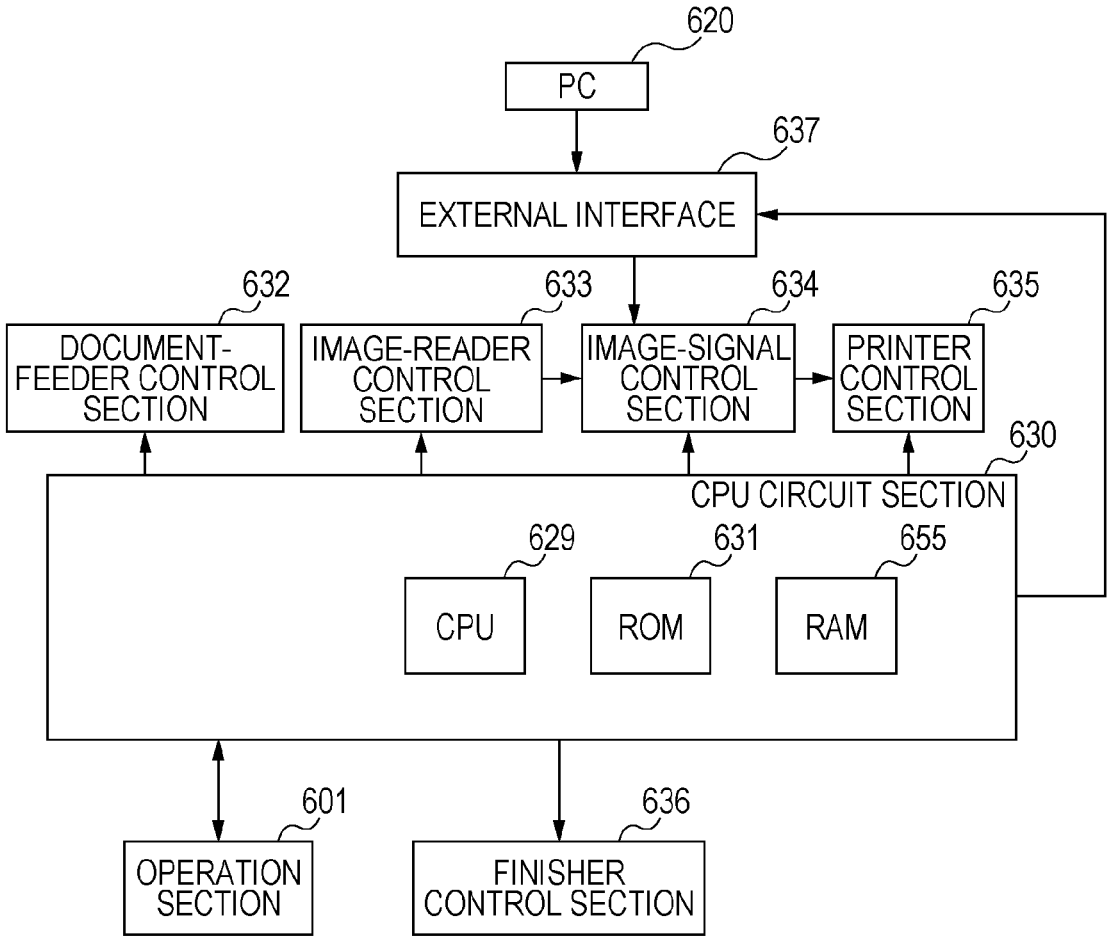
FIG. 2 is a block diagram of an image-forming-apparatus control portion according to the present embodiment.

FIG. 2 is a block diagram of an image-forming-apparatus control portion for controlling the image forming apparatus. As illustrated in FIG. 2, a central processing unit (CPU) circuit section 630 includes a CPU 629, a read-only memory (ROM) 631, and a random-access memory (RAM) 655. The CPU circuit section 630 controls a document-feeder control section 632, an image-reader control section 633, an image-signal control section 634, a printer control section 635, a finisher control section 636, and an external interface 637. The CPU circuit section 630 exercises control in accordance with a program stored in the ROM 631 and the settings of the operation section 601.

The document-feeder control section 632 controls a document feeder 650. The image-reader control section 633 controls an image reader. The printer control section 635 controls the image forming apparatus main body 600. The finisher control section 636 controls the finisher 100. For the present embodiment, a configuration in which the finisher control section 636 is incorporated in the finisher 100 is described. However, the present invention is not limited to this configuration. The finisher control section 636 may be integrated with the CPU circuit section 630 in the image forming apparatus main body 600, thus allowing the finisher 100 to be controlled from the image forming apparatus main body 600.

The RAM 655 is used as a region for temporarily storing control data or a work area for computation involved in control. The external interface 637 is an interface from a computer (personal computer (PC)) 620 and develops print data to create an image and outputs it to the image-signal control section 634. An image read by the image sensor is output from the image-reader control section 633 to the image-signal control section 634. An image output from the image-signal control section 634 to the printer control section 635 is input into an exposure control section.

Figure 3:
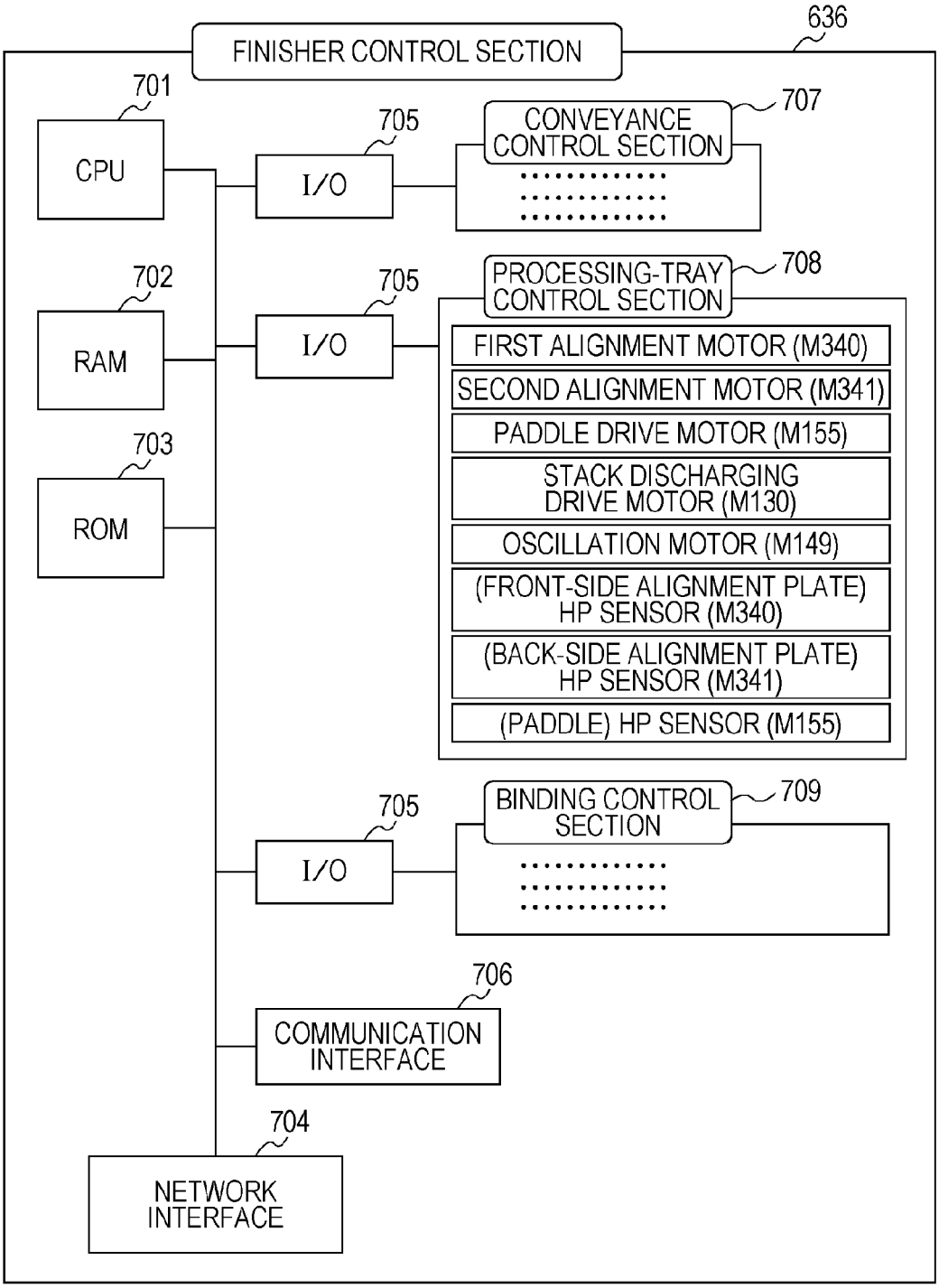
FIG. 3 is a block diagram of a finisher control section according to the present embodiment.

FIG. 3 is a block diagram of the finisher control section 636 for controlling the finisher 100.

As illustrated in FIG. 3, the finisher control section includes a microcomputer (CPU) 701, a RAM 702, a ROM 703, an input and output section (I/O) 705, a communication interface 706, and a network interface 704.

A conveyance control section 707 executes lateral registration detection control for a sheet, buffering control, and conveyance control. A processing-tray control section 708 executes operation control for an alignment plate, operation control for a drawing paddle, open and close control for an oscillation guide, bundle discharge control by use of home position (HP) sensors and movement motors.

An input port of the I/O 705 receives various sensor signals. An output port of the I/O 705 is connected to various driving systems connected through various drivers.

Sheet Processing Apparatus

Figure 4:
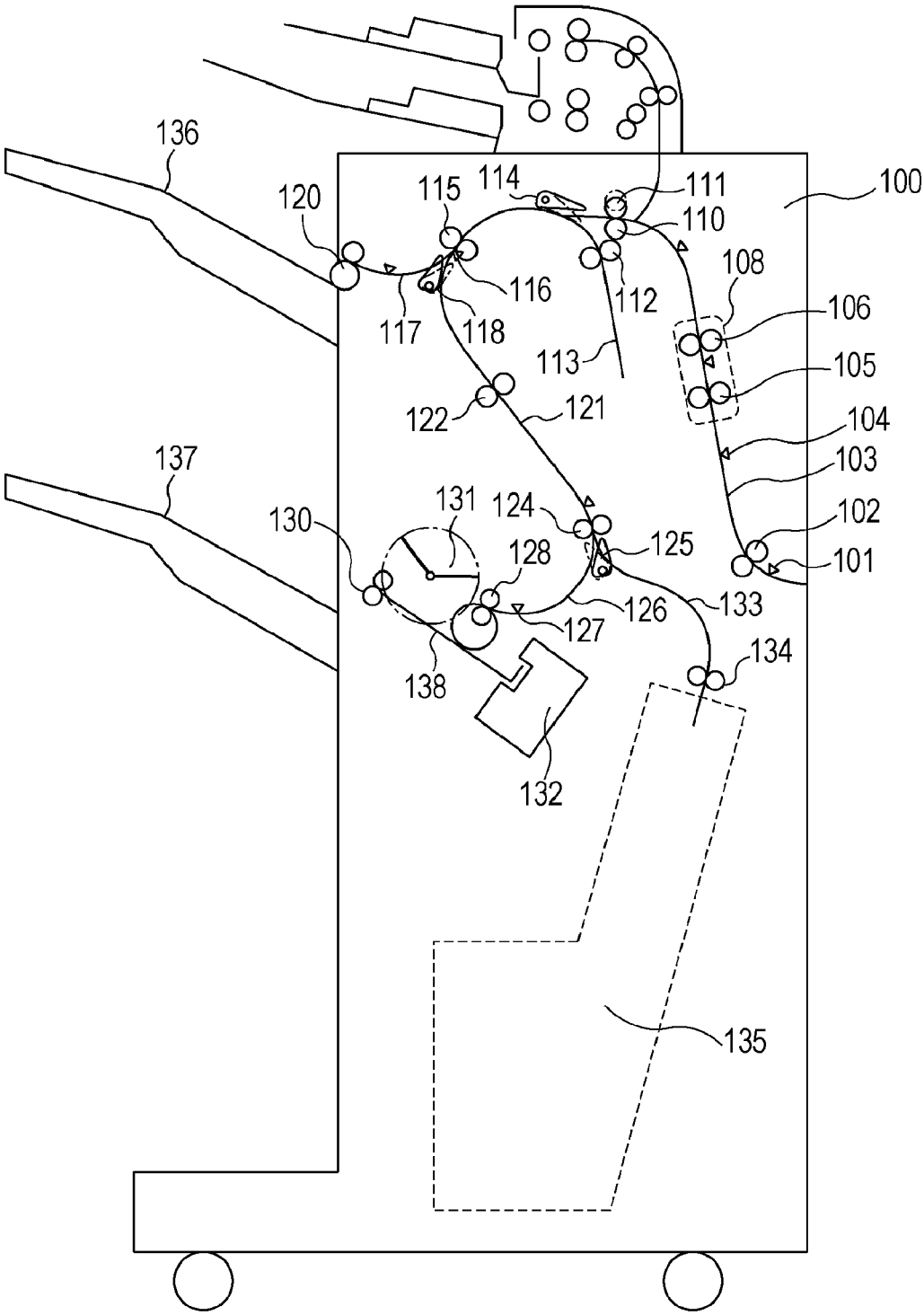
FIG. 4 is a diagram of the sheet processing apparatus according to present embodiment.

FIG. 4 is a diagram of the finisher 100 as the sheet processing apparatus. As illustrated in FIG. 4, the finisher 100 includes a processing tray 138 as a second sheet stacking tray and a stapler 132 as a sheet processing unit. The finisher 100 further includes a pair of lower discharge rollers 128 as a sheet discharge portion and drawing paddles 131 as a returning portion.

A sheet S discharged from the image forming apparatus main body 600 is delivered to a pair of entrance rollers 102 of the finisher 100. At this time, the timing of the delivery of the sheet is also detected by an entrance sensor 101 simultaneously. The sheet S conveyed by the pair of entrance rollers 102 passes through a conveyance path 103, and the position of the end of the sheet in the width direction perpendicular to the sheet conveying direction is detected by an end detection sensor 104. This detects the degree of error occurring in the position of the conveyed sheet S in the width direction with respect to the conveyance central position of the sheet processing apparatus in the width direction.

After the detection of error in the width direction, in the course of conveying the sheet S by pairs of shift rollers 105 and 106, a shift unit 108 moves frontward or backward in the width direction by a specific amount considering the error to execute a shift operation for a sheet.

After that, the sheet S conveyed by a conveyance roller 110 and a separation roller 111 is conveyed by a pair of second buffer rollers 115. After that, when the sheet S is to be discharged to an upper discharge tray 136, a switching member 118 is switched to a state indicated by the broken lines in the drawing by driving a portion (not illustrated), such as a solenoid, and the sheet S is guided to an upper path conveyance route 117 and discharged to the upper discharge tray 136 by a pair of upper discharge rollers 120.

When the sheet S is not to be discharged to the upper discharge tray 136, the sheet S conveyed by the pair of second buffer rollers 115 is guided to a bundle conveyance path 121 by the switching member 118. After that, the sheet S is made to pass through a conveyance path by a pair of third buffer rollers 122 and a pair of bundle conveying rollers 124. When the sheet S is to be subjected to saddle stitching (saddle) processing of stitching the central section of a sheet, a switching member 125 is switched to a state indicated by the broken lines in the drawing by a driving portion (not illustrated), such as a solenoid. Then the sheet is conveyed to a saddle path 133, guided to a saddle unit 135 by a pair of saddle entrance rollers 134, and subjected to saddle stitching (saddle) processing.

When the conveyed sheet S is to be discharged to a lower discharge tray 137 as a first stacking tray, the sheet S conveyed by the pair of bundle conveying rollers 124 is guided to a lower path 126 by the switching member 125. After that, the sheet S discharged to the processing tray 138 as the second stacking tray by the pair of lower discharge rollers 128 is subjected to processing on the processing tray 138 and discharged to the lower discharge tray 137 by a pair of discharge rollers 130 as a pair of conveying rotary members which constitute a conveying portion.

Sheet Discharge Control

Figure 5:
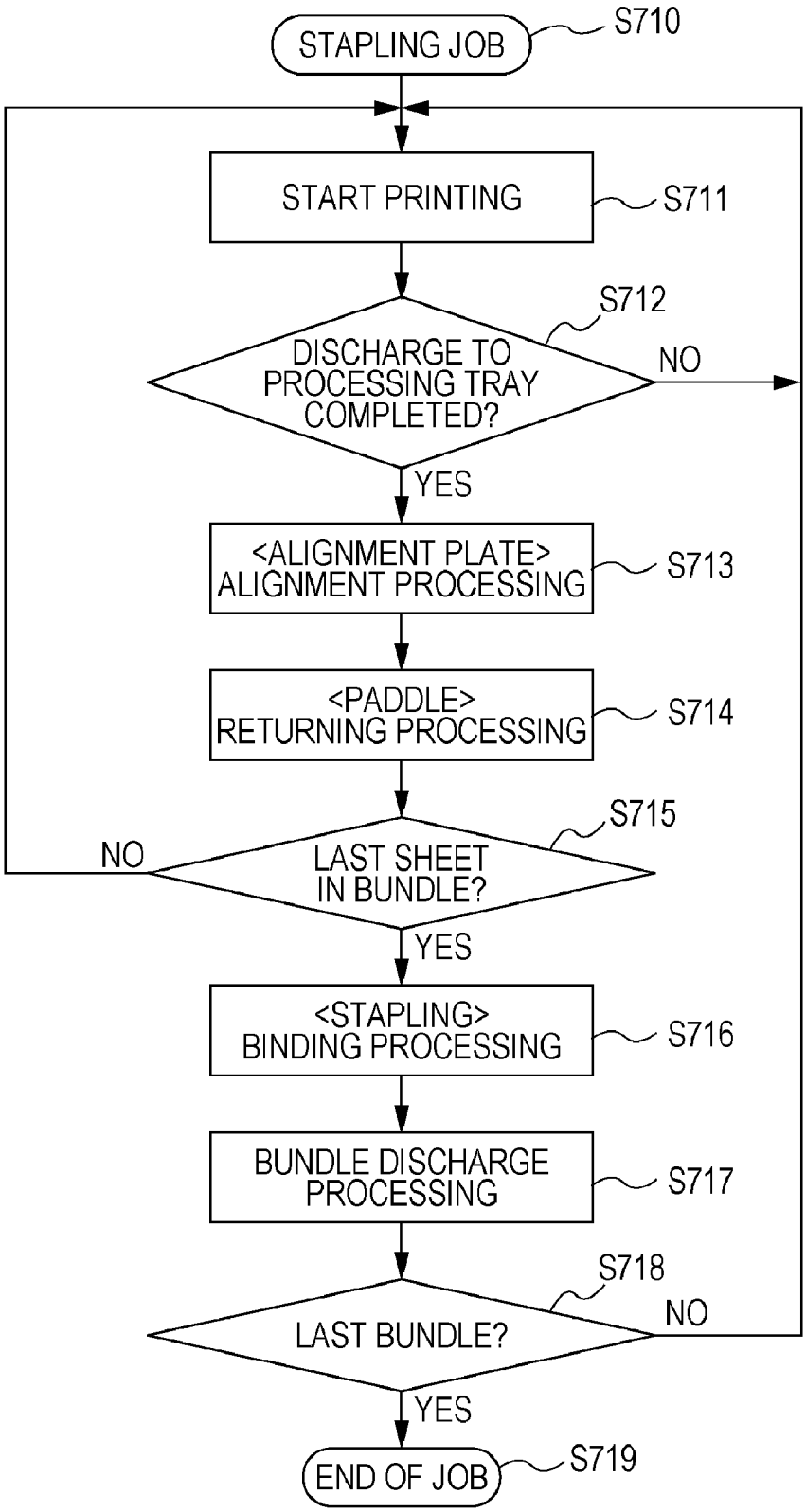
FIG. 5 is a flowchart of the finisher control section according to the present embodiment.

FIG. 5 is a flowchart occurring when a stapling job in the finisher control section is selected by the operation section 601 of the image forming apparatus main body. As illustrated in FIG. 5, when a stapling job (JOB) is selected (S710), printing is started in the image forming apparatus main body 600 (S711). Then every time one sheet is discharged to the processing tray 138 of the finisher 100 (YES in S712), alignment processing is performed by a front-side alignment plate 340 and a back-side alignment plate 341 (S713). When the alignment processing in the width direction of the sheet is completed, paddle returning processing is performed by the drawing paddles 131 (S714). When the discharged sheet is the last sheet in the bundle (YES in S715), binding processing is performed by the stapler (S716) and bundle discharge processing is performed (S717). When the discharged sheet is not the last sheet in the bundle (NO in S715), a discharge operation for the next sheet to the processing tray 138 is performed. The operations are repeated until the last bundle is reached (NO in S718). When the last bundle is reached (YES in S718), the stapling JOB is completed (S719).

Description of Buffering Processing Operation

For stapling processing or saddle processing, typically, a certain amount of processing time is necessary. This processing time partially depends on an image forming velocity of an image forming apparatus, but it is difficult to complete sheet processing within an interval between discharges of sheets, so the processing time usually exceeds the interval of discharges of sheets. Because of this, to perform sheet processing without having to stop an image forming operation of the image forming apparatus, buffering (temporary storing) is carried out.

Figure 6A:
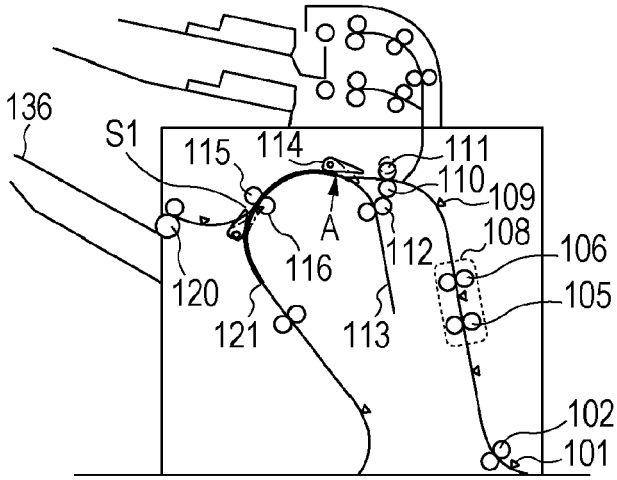
FIGS. 6A to 6C are cross-sectional views for describing operation of the sheet processing apparatus according to the present invention.
Figure 6B:
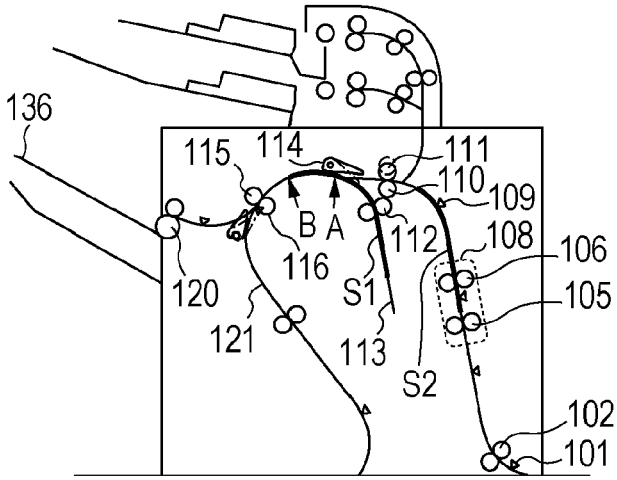
Figure 6C:
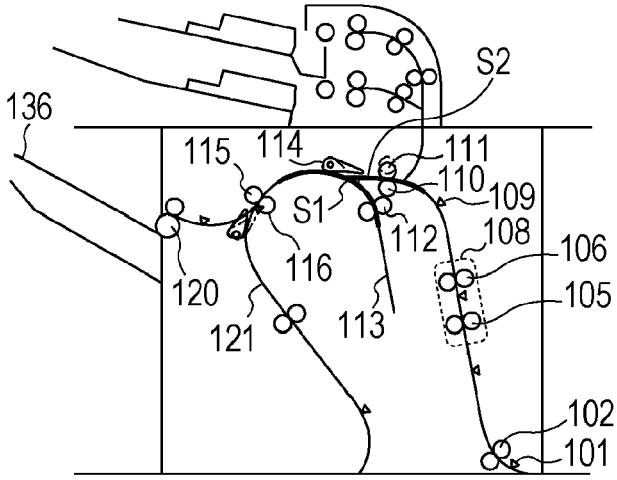

This buffering processing is described below with reference to the operation diagrams illustrated in FIGS. 6A to 6C.

A sheet S1 being the first sheet conveyed by the conveyance roller 110 and the separation roller 111 is guided to the bundle conveyance path 121 by the pair of second buffer rollers 115. At this time, the leading end of the sheet S1 is detected by a second buffer sensor 116. The pair of second buffer rollers 115 is controlled to stop on the basis of previously recognized information on the sheet size such that the sheet stops when the rear end reaches the location A (see FIG. 6A).

A switching member 114 is switched to a state indicated by the broken lines by a diving portion (not illustrated), such as a solenoid, and a reverse operation executed by the pair of second buffer rollers 115 guides the upstream end (rear end) of the sheet S1 in the sheet conveying direction in the state before being subjected to the reverse operation to a buffer path 113. Then the sheet S1 is reversely conveyed until the downstream end (leading end) of the sheet S1 in the sheet conveying direction in the state before being subjected to the reverse operation reaches the point B (see FIG. 6B).

After the leading end of a sheet S2 being the second sheet subsequently conveyed is detected by a first buffer sensor 109, the driving of a pair of first buffer rollers 112 is started such that the leading end of the sheet S2 is at the same position as that of the suspended sheet S1 when the conveyance velocity is reached. This makes a state in which the leading end of the sheet S1 and that of the sheet S2 are aligned with each other (see FIG. 6C).

Here, in order to pile one more sheet, the pair of second buffer rollers 115 is driven until the rear end of the sheet S1 and that of the sheet S2 reach the point A. After that, the above-described processing is repeated to perform staking the third sheet.

In this way, after stacking processing for a specific number of sheets is performed, the sheets are conveyed as a sheet bundle of multiple sheets to the processing tray portion or the saddle unit by the pair of third buffer rollers 122 and the pair of bundle conveying rollers 124 downstream in the sheet conveying direction.

Description of Processing Tray Portion

Next, the processing tray portion is described using FIGS. 7 to 10.

Figure 7:
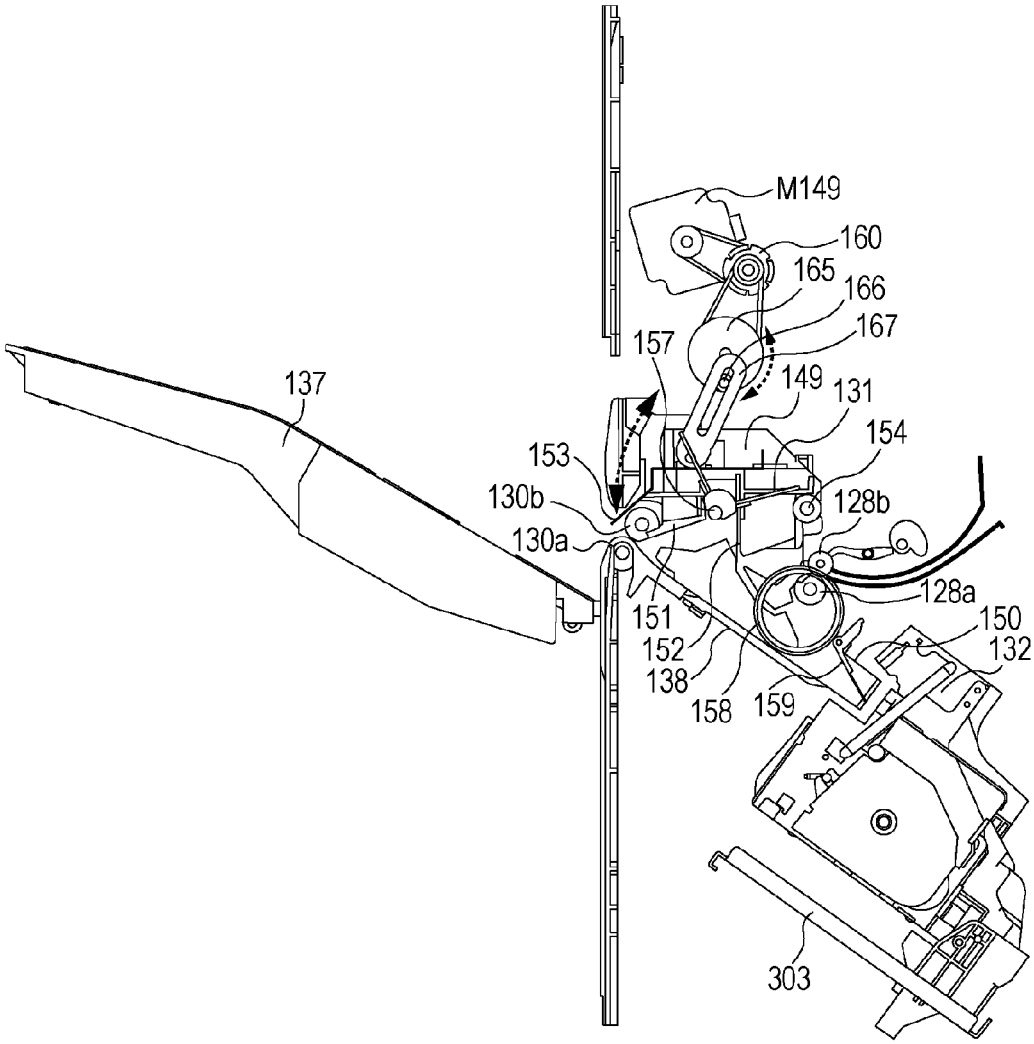
FIG. 7 is an illustration for describing a processing tray according to the present embodiment.

As illustrated in FIG. 7, the processing tray 138 as the second stacking tray is inclined such that, with respect to the sheet conveying direction for a sheet bundle, the downstream side (left-hand side in FIG. 7) is upper and the upstream side (right-hand side in FIG. 7) is lower. At the upstream end of the processing tray 138 in the sheet conveying direction, a rear-end stopper (regulation member) 150 is arranged. At the downstream end of the processing tray 138 in the sheet conveying direction, a lower discharge roller 130*a* of the pair of discharge rollers 130 is arranged.

An oscillation guide 149 is provided with a guiding guide 151, a first antistatic needle 152, and a second antistatic needle 153 arranged so as to extend across the axial direction. The oscillation guide 149 is rotatably supported by a support shaft 154 and can be made to oscillate upward and downward by an oscillation motor M149. An upper discharge roller 130*b* of the pair of discharge rollers 130 is arranged at an open end of the openable and closable oscillation guide 149. The upper discharge roller 130*b* can be separated from and come into contact with the lower discharge roller 130*a* in response to open or close operation of the oscillation guide 149. Rotation drive is applied from a bundle discharging drive motor M130 being a driving portion to the upper and lower discharge roller shaft portions of the pair of discharge rollers 130, and the pair of discharge rollers 130 can rotate in forward and reverse directions. This enables the pair of discharge rollers 130 to discharge a sheet in a discharge direction in which the sheet is discharged onto the lower discharge tray 137 and to convey the sheet in a sheet conveying direction in which the sheet is conveyed onto the processing tray 138, the sheet conveying direction being opposite to the discharge direction.

Next, a sheet rear-end alignment portion is described. A belt roller 158 as a sheet conveyance portion and a rear-end lever 159 as a sheet pressing member are arranged adjacent to an upstream side of the processing tray 138 in the sheet conveying direction. A sheet is abutted against the rear-end stopper 150 by rotation of the belt roller 158 in a direction in which a sheet is moved oppositely to the discharge direction of the pair of lower discharge rollers 128 while being guided by the rear-end lever 159, and alignment in the sheet conveying direction is carried out.

The configuration is specifically described below. The belt roller 158 is passed around a discharge roller 128*a* included in the pair of lower discharge rollers 128 as the sheet discharge portion and rotates so as to follow rotation of the discharge roller 128*a*. The belt roller 158 is disposed above the processing tray 138 in a positional relation in which the lower portion of the belt roller 158 is in contact with the topmost sheet stacked on the processing tray 138.

Figure 8:
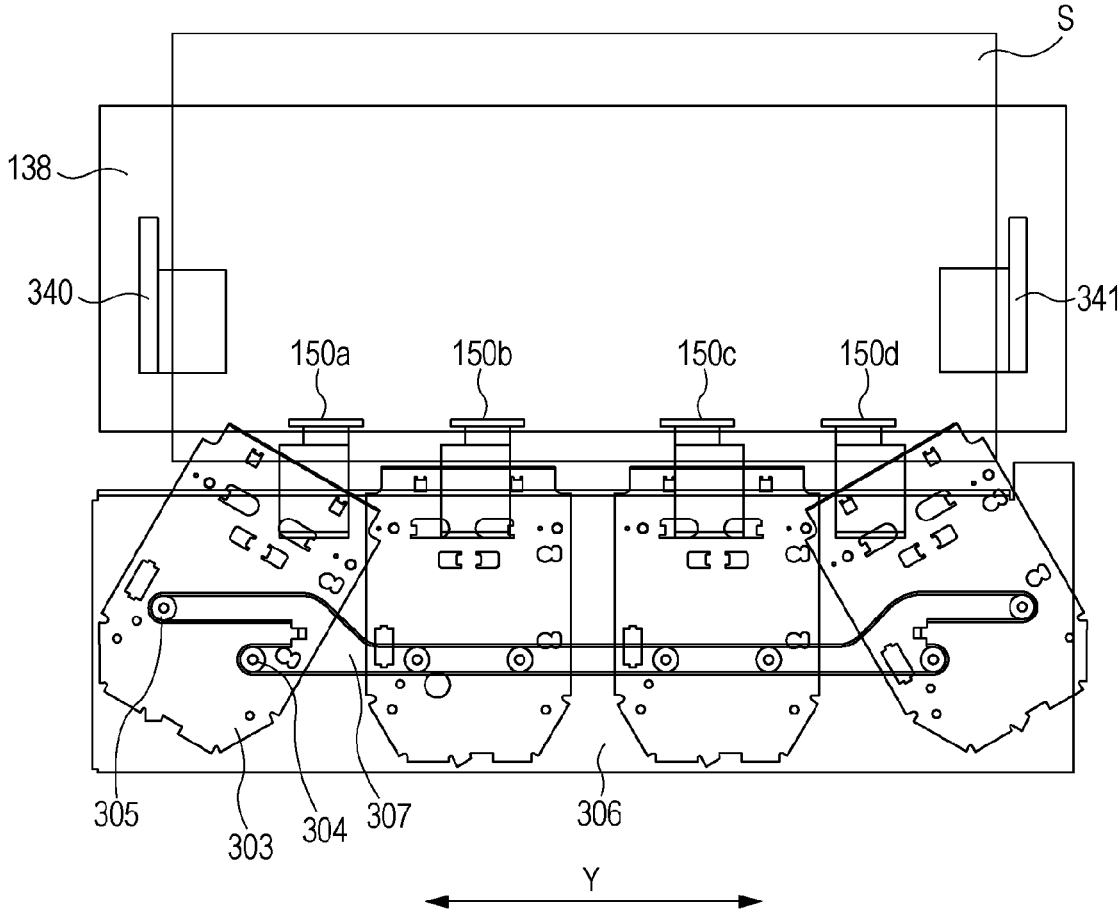
FIG. 8 is a top view for describing a stapling portion according to the present invention.

The stapler 132 is fixed on a slide support 303. As illustrated in FIG. 8, rollers 304 and 305 are disposed below the slide support 303. The slide support 303 is moved along the rear-end edge of a sheet S stacked on the processing tray 138 (in the direction indicated by the arrows Y) while being guided by the rollers 304 and 305 and a guide rail groove 307 on a stapler carriage 306.

Figure 9:
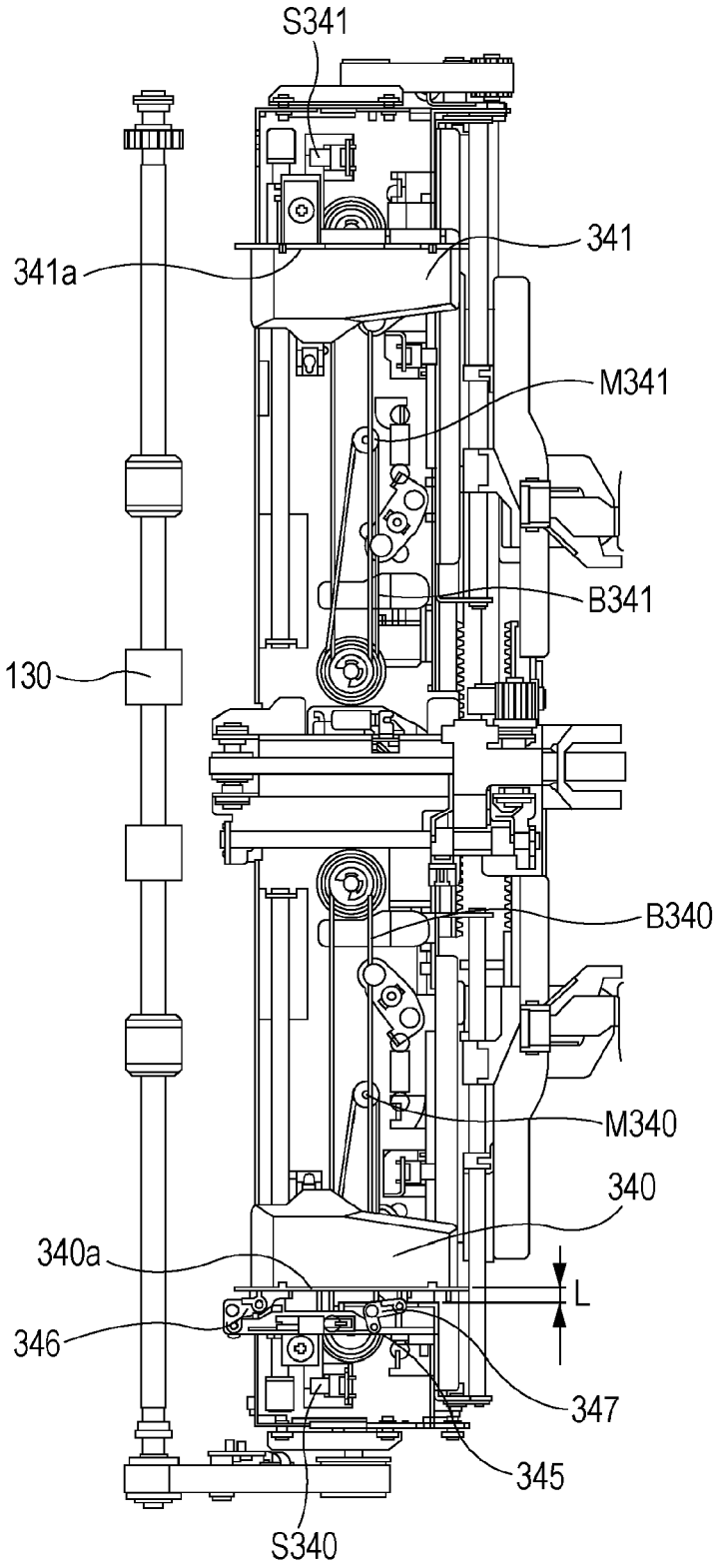
FIG. 9 is an illustration for describing an aligning portion according to the present embodiment.

FIG. 9 is a top view of the processing tray portion. As illustrated in FIG. 9, the front-side alignment plate 340 (first alignment member) and the back-side alignment plate 341 (second alignment member) forming an alignment portion align opposite ends of a sheet accommodated in the processing tray 138 in the width direction orthogonal to the sheet conveying direction.

The first and second alignment members 340 and 341 are arranged so as to face the opposite ends of a sheet S above the processing tray 138. The first and second alignment members 340 and 341 include alignment surfaces 340*a* and 341*a*, respectively, being perpendicular to the stacking surface of the processing tray 138 and press the side ends of the sheet.

The alignment portion includes first and second alignment motors M340 and M341 capable of independently driving the first and second alignment members 340 and 341, respectively. Drive is transmitted from the leading-end pulleys of the alignment motors M340 and M341 to the first and second alignment members 340 and 341 through timing belts B340 and B341. Here, the alignment motors M340 and M341, the leading-end pulleys, and the timing belts B340 and B341 form a driving portion. This enables the first and second alignment members 340 and 341 to be able to move along the width direction of a sheet independently with respect to the processing tray 138. That is, the alignment surfaces 340*a* and 341*a* are arranged above the stacking surface of the processing tray 138 so as to face it, and each driving portion is attached adjacent to a surface opposite to the stacking surface so as to be able to move forward and reversely in the width direction.

Here, HP sensors 5340 and 5341 for detecting the home positions of the first and second alignment members 340 and 341, respectively, are arranged. When being not in operation, the first and second alignment members 340 and 341 wait at the respective home positions (the opposite ends of the processing tray 138 in the width direction).

Figure 10:
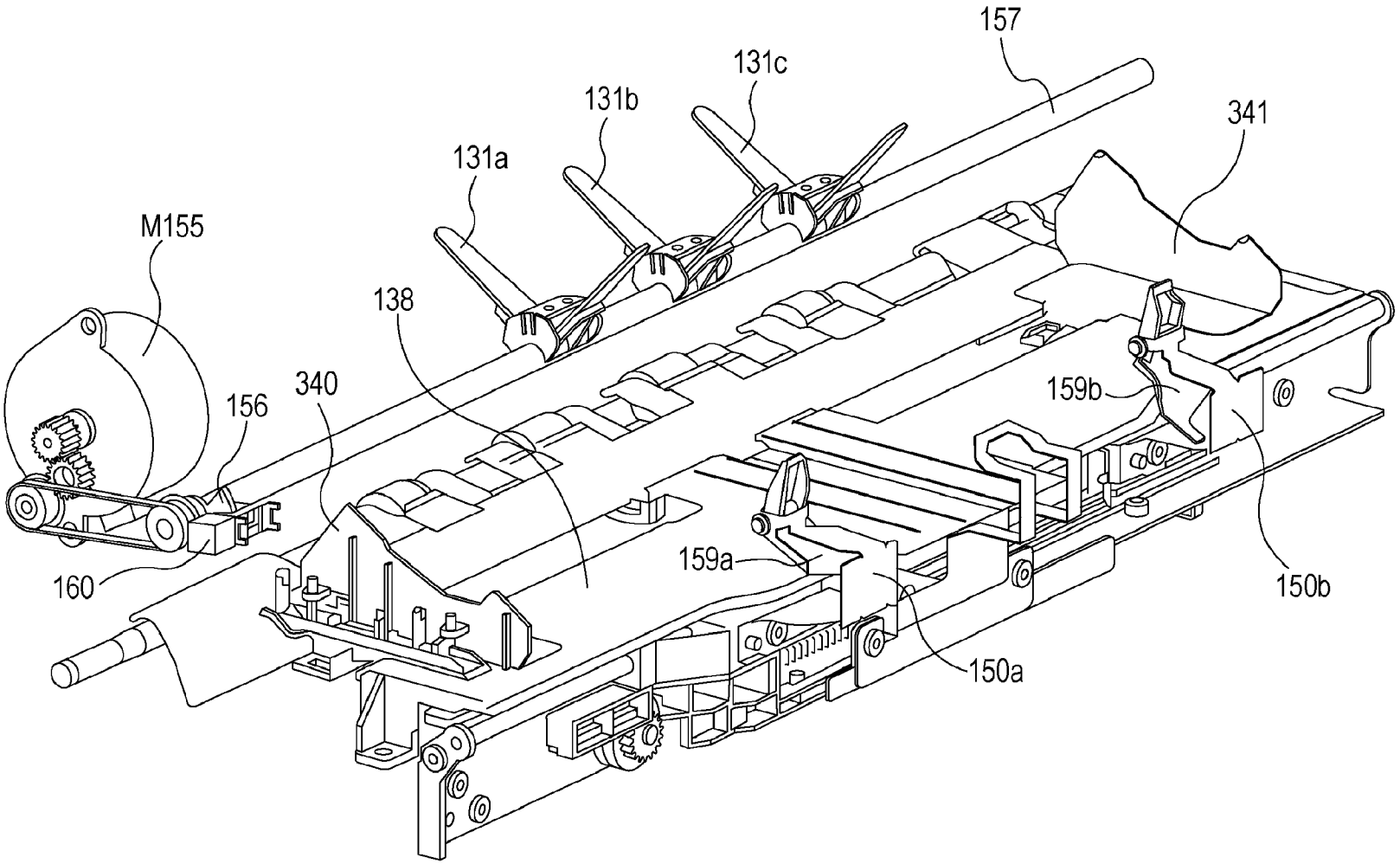
FIG. 10 is a diagram of a returning portion according to the present embodiment.

As illustrated in FIG. 10, the drawing paddles 131 (131*a*, 131*b*, 131*c*) are arranged above the processing tray 138, and the plurality of drawing paddles 131 are fixed on a rotary shaft 157 drivingly coupled to a paddle drive motor M155 by a gear train. The drawing paddles 131 are rotary bodies that are rotatable counterclockwise in FIG. 7 at appropriate timing by the paddle drive motor M155. The plurality of drawing paddles 131 are disposed along the axial direction of the rotary shaft 157. The provision of the plurality of drawing paddles 131 enables the plurality of drawing paddles 131 to evenly come into contact with the surface of a sheet in drawing the sheet to rear-end stoppers 150*a* and 150*b* by use of the drawing paddles 131, so turning of the sheet caused by uneven contact can be prevented. Because of this, the sheet can be reliably abutted against the rear-end stoppers 150*a* and 150*b* without being skewed.

Description of Operation of Discharge Portion in Staple Sort Mode

Figure 11A:
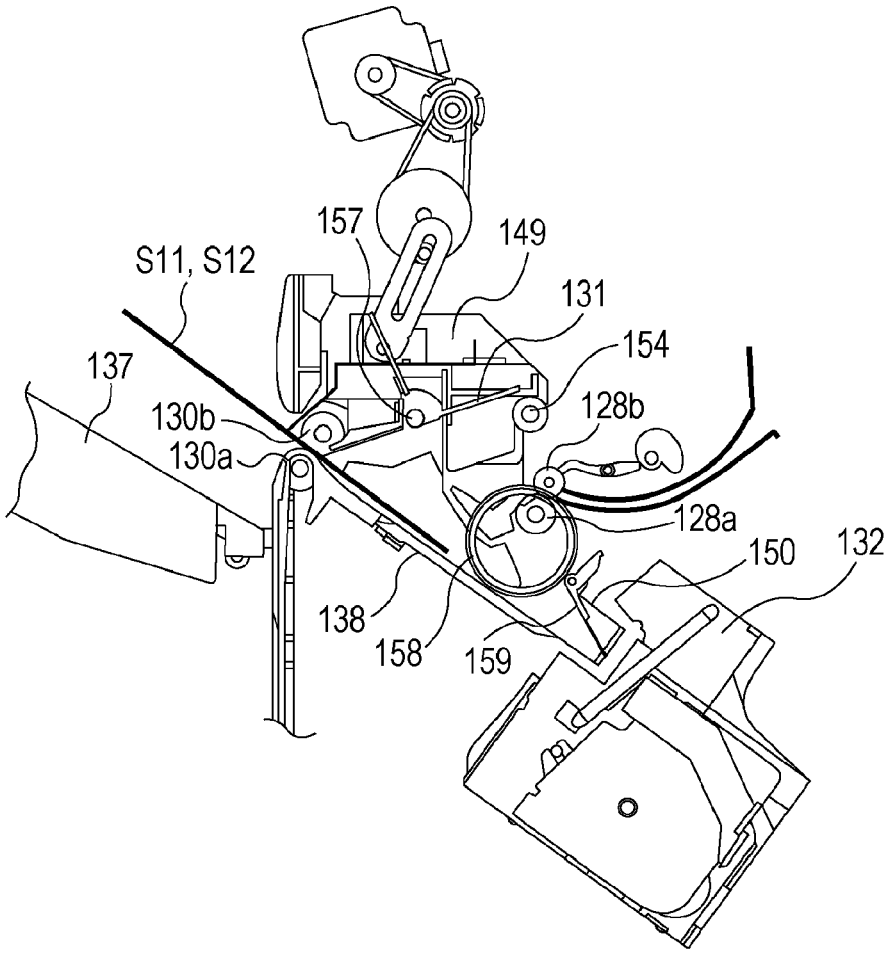
FIGS. 11A and 11B are illustrations for describing how a sheet flows and how the processing tray operates in staple sort mode.
Figure 11B:
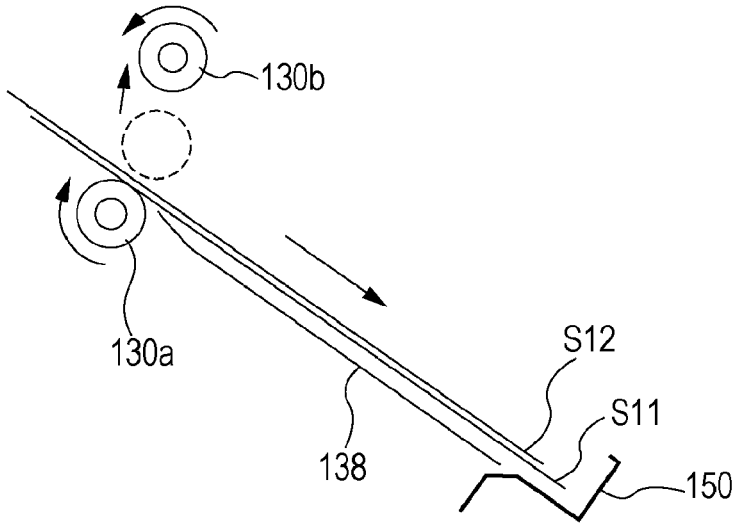

How a sheet flows in staple sort mode is described using FIGS. 11A and 11B.

When the staple sort mode is selected, sheets from a sheet S11 being the first page in the first portion discharged from the image forming apparatus main body 600 to a subsequent specific page are successively conveyed in either one of the front and back directions while being shifted by a specific amount by the shift unit 108. At this time, the sheets S11 and S12 being the initial and second pages are piled by buffering processing in the buffer path in an imbricate state in which the ends of the two sheets are displaced. The sheets S11 and S12 subjected to buffering processing are conveyed from the pair of lower discharge rollers 128 to the pair of discharge rollers 130. After their rear ends move out of the pair of lower discharge rollers 128, these two sheets are sent by a specific amount by forward rotation of the pair of discharge rollers 130 such that a sheet in contact with the upper discharge roller 130*b* and a sheet in contact with the lower discharge roller 130*a* are conveyed with the same velocity (FIG. 11A).

After that, the pair of discharge rollers 130 is rotated reversely, and the sheets are conveyed with the conveyance velocity Vb in a direction opposite to the discharge direction of the pair of discharge rollers 130 such that the rear ends of the sheets are abutted against the rear-end stopper 150. Before the rear ends of the sheets are abutted against the rear-end stopper 150, the oscillation guide 149 is raised to separate the upper discharge roller 130*b* and the lower discharge roller 130*a*. This causes the conveyed sheet S11 to slide toward the rear-end stopper 150 by inclination of the stacking surface of the processing tray 138 and inertial force of the conveyance velocity Vb and, in particular, it can prevent buckling, which is apt to occur in a thin sheet (FIG. 11B). The details of an operation occurring in the sheet bundle when the buffered sheet bundle is conveyed from the pair of lower discharge rollers 128 to the pair of discharge rollers 130 and the sheets are aligned by being abutted against the rear-end stopper 150 by reverse conveyance of the pair of discharge rollers 130 are described below.

Figure 12A:
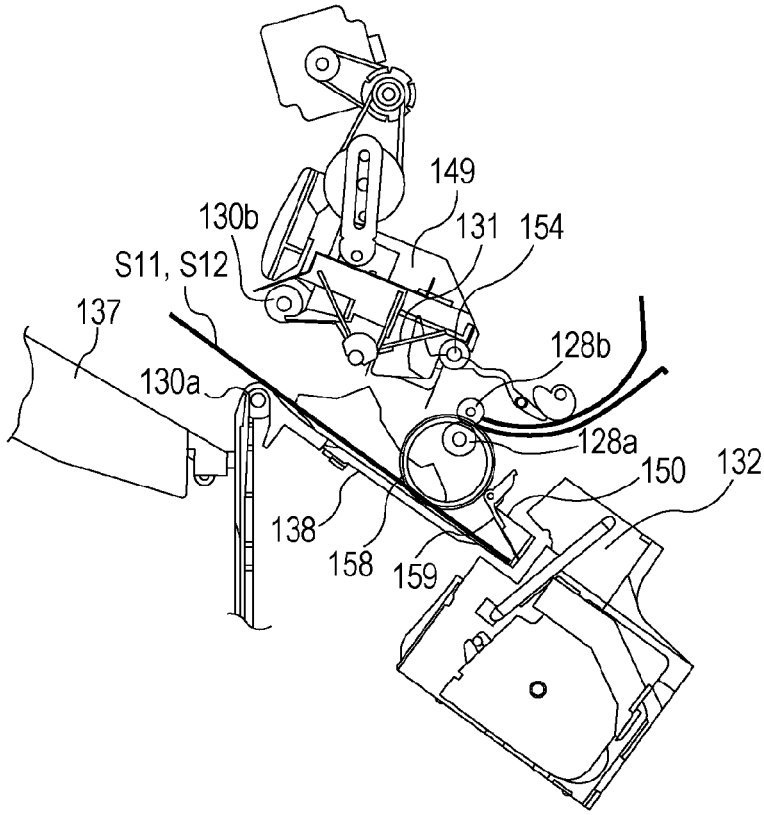
FIGS. 12A and 12B are illustrations for describing how a sheet flows and how the processing tray operates in staple sort mode.

When the alignment of the upstream ends (rear ends) of the sheets S11 and S12 in the sheet conveying direction is completed, alignment in the width direction orthogonal to the sheet conveying direction is then performed by the first and second alignment members 340 and 341 (FIG. 12A).

Figure 12B:
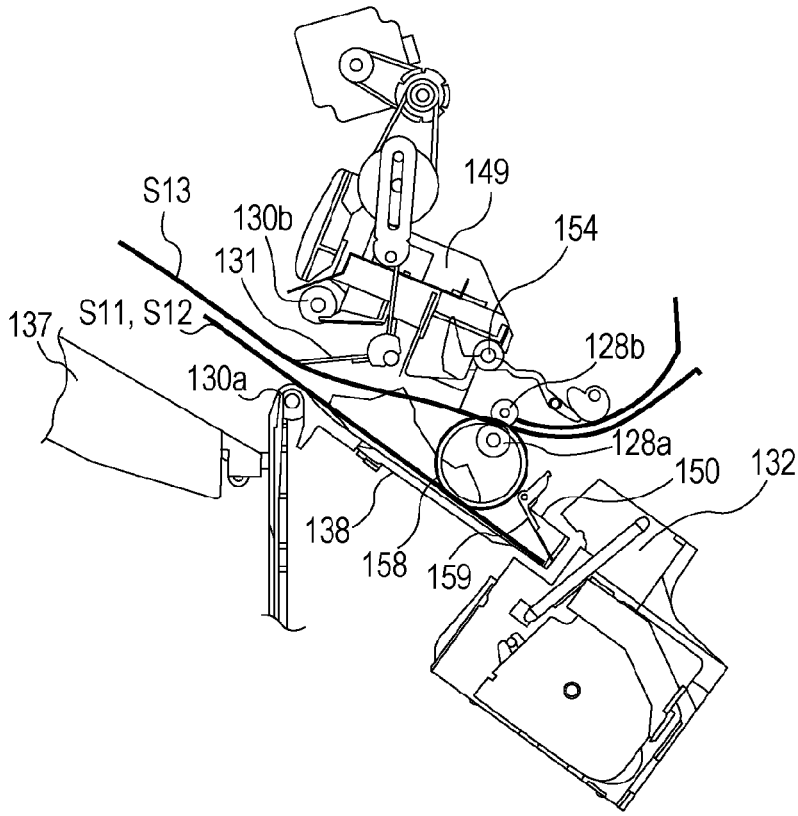

Next, a sheet S13 being the third page in the first portion is discharged from the pair of lower discharge rollers 128 to the processing tray 138. At this time, the oscillation guide 149 is at a raised position, and the sheet S13 is received in a state where the upper discharge roller 130*b* and the lower discharge roller 130*a* are separated from each other. When the rear end of the sheet S13 moves out of the nip between the pair of lower discharge rollers 128, the sheet S13 is discharged onto the processing tray 138. The sheet S13 discharged onto the processing tray 138 is conveyed by rotation of the drawing paddles 131 in a direction in which the sheets are moved oppositely to the discharge direction of the pair of lower discharge rollers 128 such that the sheet end of the sheet S13 is directed toward the rear-end stopper 150 (FIG. 12B).

The sheet S13 is further attracted near the rear-end stopper 150 by the belt roller 158 rotating in a direction in which the sheet is moved oppositely to the discharge direction, and then the sheet S13 is abutted against the abutting surface of the rear-end stopper 150 and is aligned. When the alignment of the upstream end (rear end) of the sheet S13 in the sheet conveying direction is completed, as in the case of the sheets S11 and S12, alignment in the width direction is performed by the first and second alignment members 340 and 341. This series of operations are repeated until the last sheet S1*n* in the first set is abutted against the rear-end stopper 150.

Figure 13A:
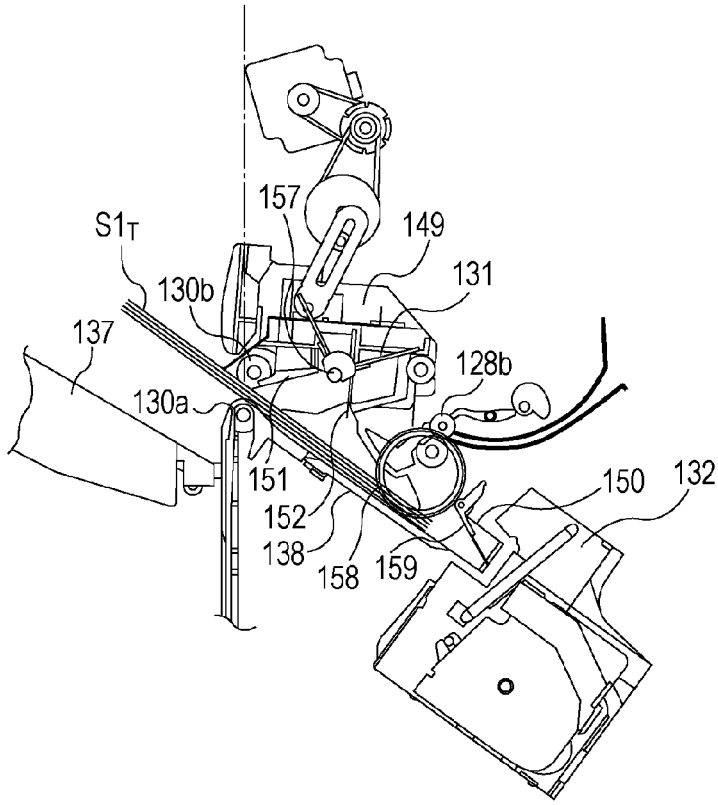
FIGS. 13A and 13B are illustrations for describing how a sheet flows and how the processing tray operates in staple sort mode.
Figure 13B:
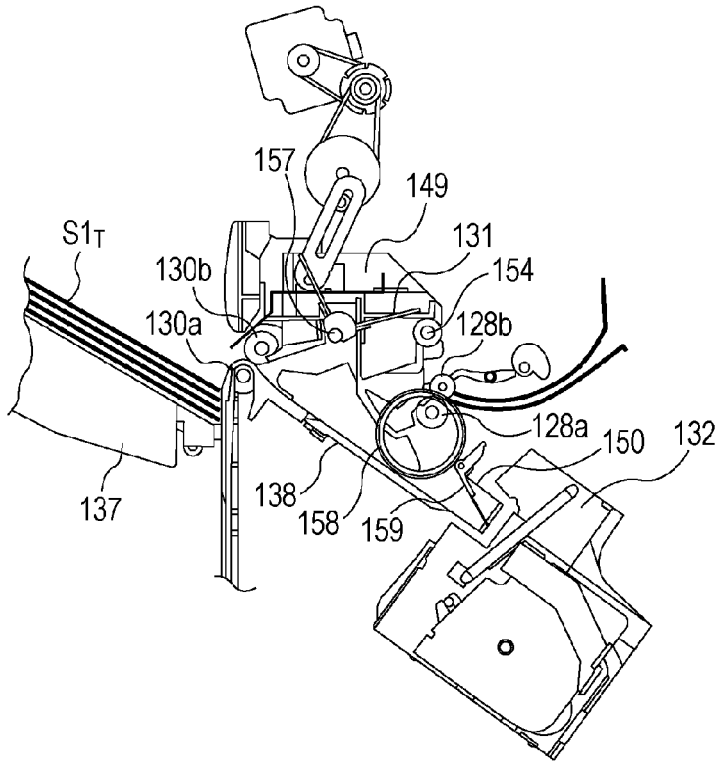

When the alignment operation for the last sheet S1*n* is completed, the rear-end edge of a sheet bundle S1T is stapled by the stapler 132. Then, as illustrated in FIG. 13A, the oscillation guide 149 is lowered, the sheet bundle S1T is pinched by the pair of discharge rollers 130, and the sheet bundle S1T is discharged to the lower discharge tray 137 (FIG. 13B).

The time required for a stapling operation and an operation of discharging the sheet bundle of the first set to the lower discharge tray 137 after the last sheet S1*n* in the first set is abutted against the rear-end stopper 150 is an additional time aside from normal sheet processing. During this time, a sheet S21 being the first page in the second portion cannot be received.

As previously described, for the sheet processing apparatus according to the present embodiment, during sheet processing on the first portion on the processing tray 138, sheets discharged from the image forming apparatus main body 600 are subjected to buffering processing. This enables processing of successively receiving sheets in a subsequent portion from the image forming apparatus main body 600 and not discharging the sheets to the processing tray 138. For the present embodiment, the reason why buffering processing, which is originally necessary for conveyance control on second and subsequent portions, is also performed on the initial page and the second page in the first portion is carrying out common conveyance control for all portions. When conveyance of a sheet included in the sheet bundle of the first portion starts, if the sheet bundle is not processed on the processing tray 138, there is no need to perform buffering processing on the initial page and the second page in the first portion. However, if the initial page and the second page in the first portion are not subjected to buffering processing, it would be necessary to execute different kinds of conveyance control on the first portion and on second and subsequent portions.

Figure 14:
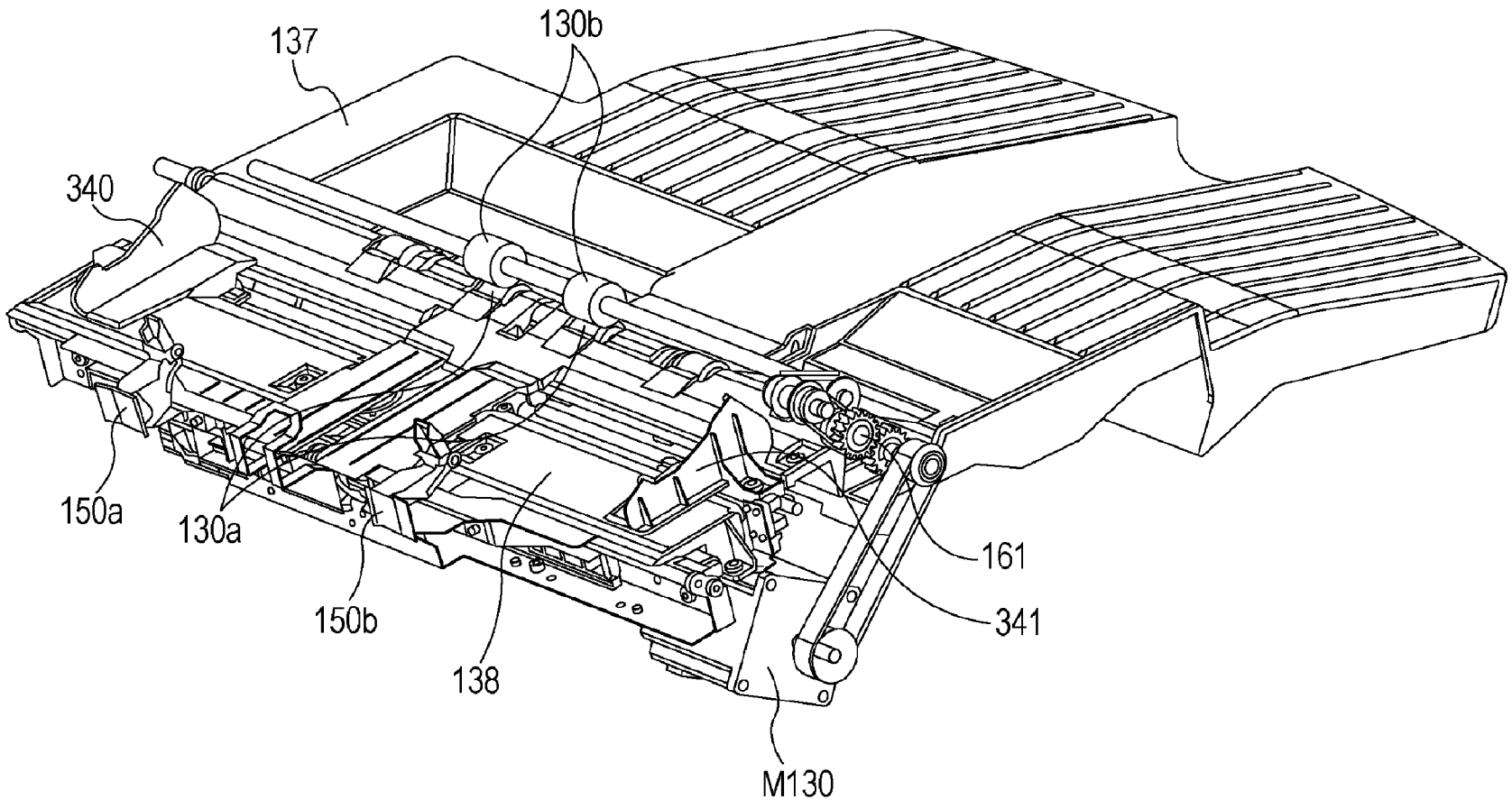
FIG. 14 is a perspective view for describing a configuration of a sheet-bundle conveying portion.

Next, conveyance control on a sheet bundle in which a plurality of sheets are piled by buffering processing, which is a characteristic of the present invention, is described. FIG. 14 is a perspective view of a detailed configuration of the pair of discharge rollers 130.

The upper discharge roller 130*b* has a roller diameter larger than that of the lower discharge roller 130*a* by approximately 5% (the upper discharge roller 130*b*=ϕ22 mm, the lower discharge roller 130*a*=ϕ20.9 mm).

The upper discharge roller 130*b* incorporates a one-way clutch 161 and is drivingly coupled to the bundle discharging drive motor M130, as well as the lower discharge roller 130*a*, through a transmission gear disposed on a rotary shaft. The one-way clutch 161 is locked only in conveying a sheet by the pair of discharge rollers 130 toward the rear-end stopper 150 and has a configuration in which the bundle discharging drive motor M130 directly transmits rotation drive to the upper discharge roller 130*b*. Accordingly, in conveying a sheet toward the lower discharge tray 137 (first direction), the one-way clutch 161 idles with respect to the rotary shaft, so the pinch pressure of the lower discharge roller 130*a* and turning force resulting from the coefficient μ of kinetic friction through the sheet are applied to the upper discharge roller 130*b*.

Figure 15A:
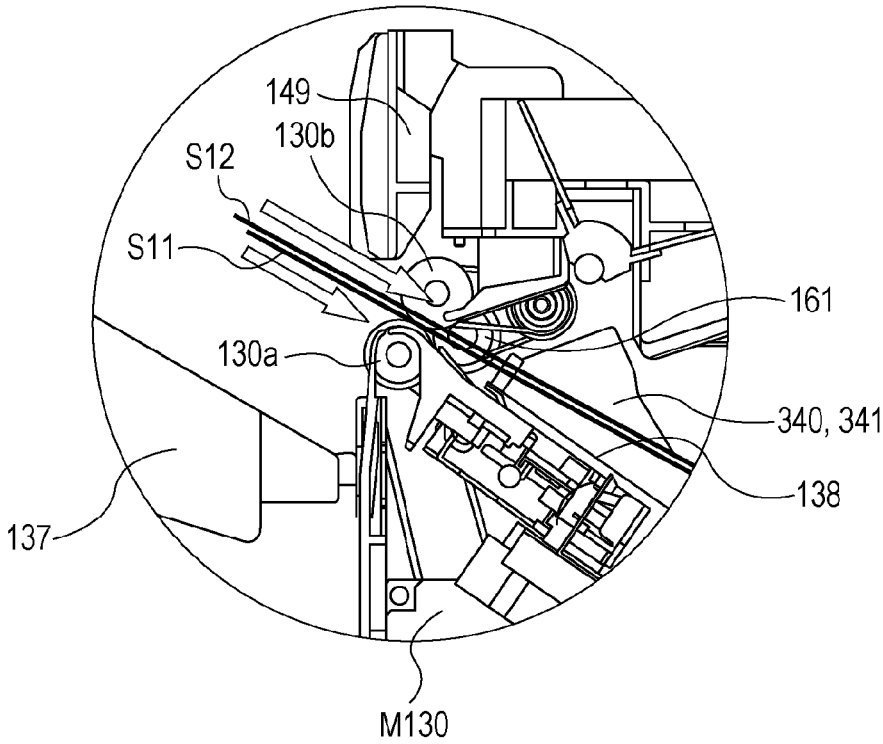
FIGS. 15A and 15B are illustrations for describing operation on a sheet during conveyance of a sheet bundle.
Figure 15B:
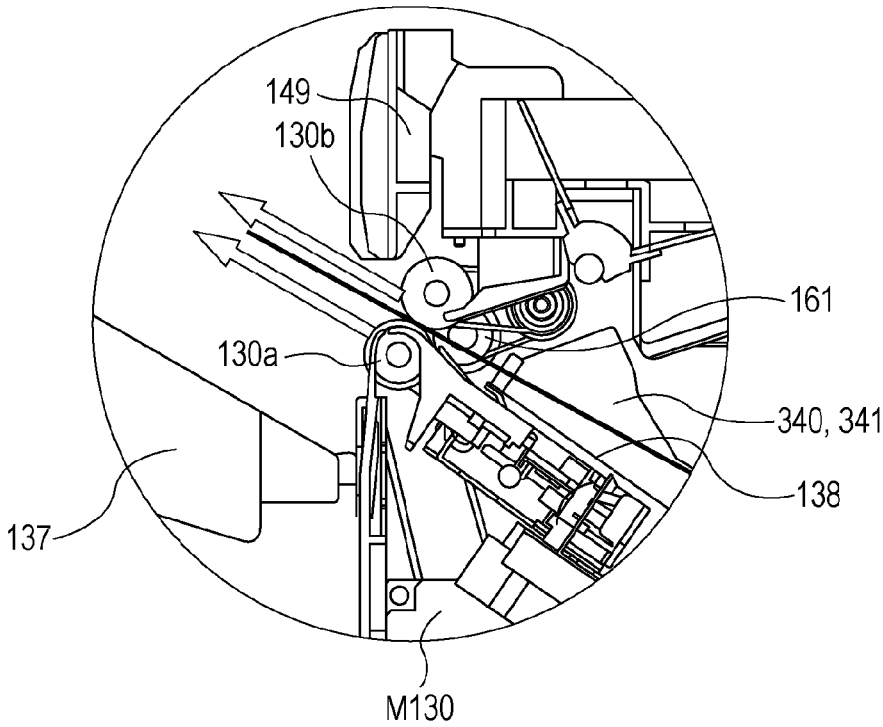

FIGS. 15A and 15B are illustrations for operation occurring in conveying a sheet bundle.

As illustrated in FIG. 15A, in conveying a sheet bundle by the pair of discharge rollers 130 toward the rear-end stopper 150 (second direction), rotation drive is directly transmitted to the upper discharge roller 130*b*. Therefore, a difference of 5% is present between the sheet conveyance velocity of the upper discharge roller 130*b* and that of the lower discharge roller 130*a* because of the difference in roller diameter. That is, the distance of movement per unit time of the sheet S12 coming into contact with the upper discharge roller 130*b* of the sheet bundle is longer than that of the sheet S11 coming into contact with the lower discharge roller 130*a*. Accordingly, in conveying the sheet bundle by the pair of discharge rollers 130 toward the rear-end stopper 150 (second direction), displacement occurs between the sheets S11 and S12 in the sheet conveying direction. For the present embodiment, the distance in which the pair of discharge rollers 130 is reversed and the rear end of the sheet bundle is abutted against the rear-end stopper 150 is set at approximately 100 mm. This produces a displacement of 5 mm in the sheet conveying direction between the sheets S11 and S12 during conveyance of the sheets toward the rear-end stopper 150 (second direction). Due to this displacement, when sheets of coated paper having good surface nature or film sheets are conveyed as a sheet bundle subjected to buffering processing to the processing tray 138, even if adhesion occurs between the sheets during conveyance, the adhesion between the sheets can be removed before they are abutted against the rear-end stopper 150. The sheets S11 and S12 whose adhesion is removed slide toward the rear-end stopper 150 by inertial force after separation of the upper discharge roller 130*b* and the lower discharge roller 130*a* and inclination of the stacking surface of the processing tray 138 while their ends are displaced, so the sheets can be satisfactorily aligned in the sheet conveying direction.

As illustrated in FIG. 15B, in conveying a sheet by the pair of discharge rollers 130 toward the lower discharge tray 137 (first direction), the one-way clutch 161 idles with respect to the rotary shaft. Thus the upper discharge roller 130*b* rotates as a follower roller through the sheet so as to match with the sheet conveying velocity of the lower discharge roller 130*a*. Because of this, a sheet in contact with the upper discharge roller 130*b* and a sheet in contact with the lower discharge roller 130*a* are conveyed at the same sheet conveyance velocity (amount of conveyance). Accordingly, in conveying a sheet bundle toward the lower discharge tray 137, like in not-binding sort mode or in discharge of the sheet bundle after binding processing (FIG. 15A), displacement caused by the difference between the sheet conveyance velocities at which the upper discharge roller 130*b* and the lower discharge roller 130*a* convey the respective sheets in contact therewith does not occur. For the present embodiment, the difference between the sheet conveyance velocity of the upper discharge roller 130*b* and that of the lower discharge roller 130*a* is set at 5%. However, even with the velocity difference more than or less than 5%, advantageous effects of handling more than a certain degree can be expected. That is, as long as sheets can be conveyed such that the sheet conveyance velocity for a sheet in contact with one of the pair of discharge rollers 130 is different from that for a sheet in contact with the other of the pair of discharge rollers 130, advantageous effects of the present invention are obtainable.

The amount of displacement between sheets subjected to buffering processing has an effect upon alignment performed by causing a sheet bundle to be abutted against the rear-end stopper 150, so an optimal amount of displacement varies depending on the size of a sheet, the basis weight of a sheet, and surface nature. Accordingly, for the present embodiment, the amount of displacement during buffering processing and the amount of displacement resulting from the difference between the amount of conveyance of the upper discharge roller 130*b* and that of the lower discharge roller 130*a* can be changed. One example method of changing the amount of displacement using the difference of the amounts of sheet conveyance can be reversing the pair of discharge rollers 130 and changing the distance from the rear end of a sheet bundle to the contact with the rear-end stopper 150 (for the present embodiment, 100 mm). In contrast to the present embodiment, the roller diameter of the upper discharge roller 130*b* may be smaller than that of the lower discharge roller 130*a*. In this case, the one-way clutch 161 can be disposed on the rotary shaft of the lower discharge roller 130*a*, and in conveying a sheet toward the lower discharge tray 137, the lower discharge roller 130*a* is rotated so as to match with the conveyance velocity of the upper discharge roller 130*b*, similar advantageous effects are obtainable.

Second Embodiment

Figure 16:
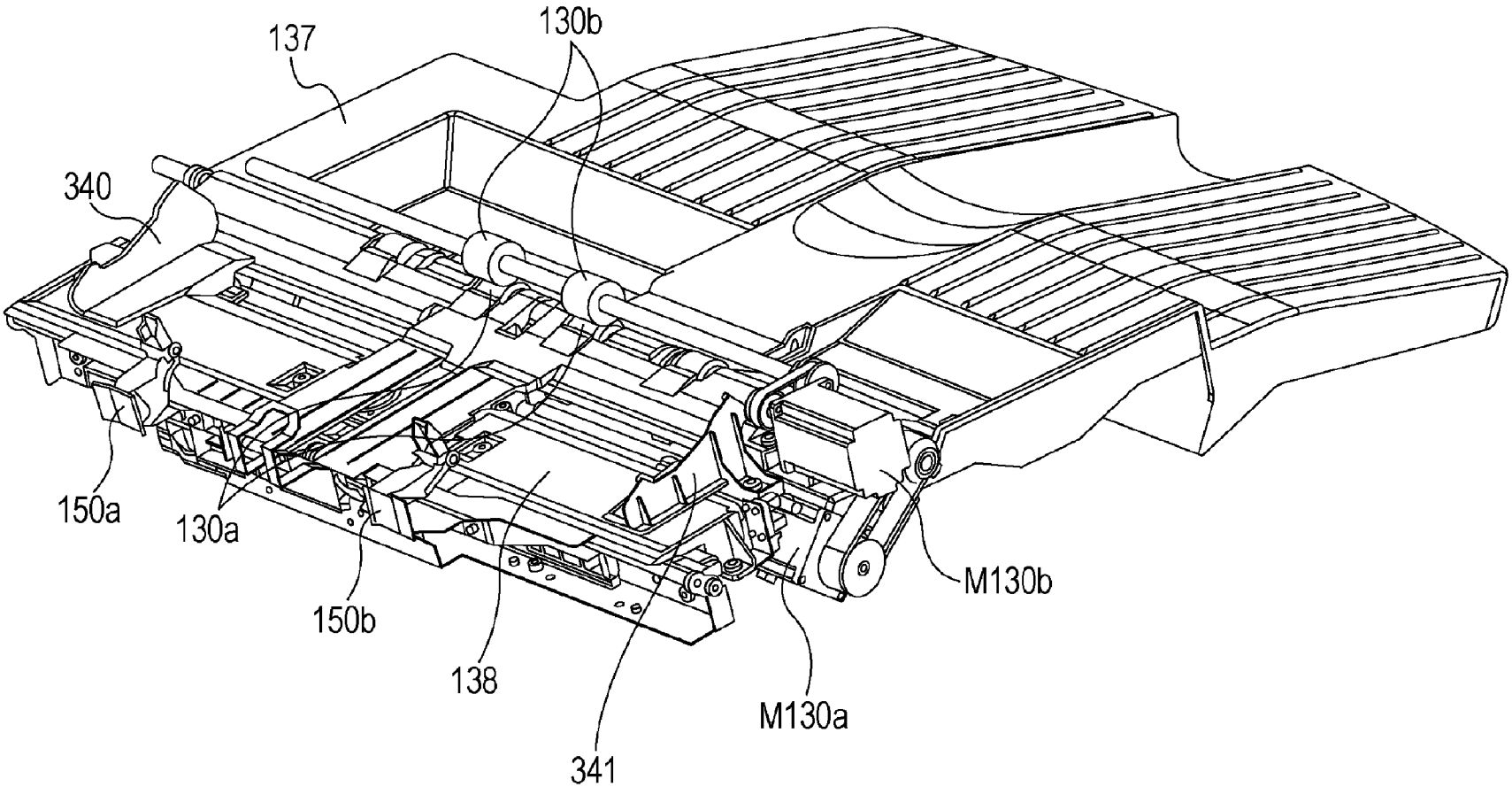
FIG. 16 is a perspective view for describing a configuration of a sheet-bundle conveying portion according to a second embodiment.

FIG. 16 illustrates another embodiment of the present invention. The present embodiment differs from the above-described first embodiment in that, whereas in the first embodiment the upper discharge roller and the lower discharge roller have different roller diameters and the one-way clutch is incorporated in one of the pair of discharge rollers, the pair of discharge rollers 130 can be independently driven in the present embodiment. Here, a configuration different from that of the first embodiment is described in detail, and the description of the other configuration and operation, which are the same as in the first embodiment, is omitted.

The sheet processing apparatus according to the present embodiment includes independent bundle discharging drive motors M130*a* and M130*b* for the respective lower discharge roller 130*a* and upper discharge roller 130*b*, and the conveyance velocity varies depending on the conveying direction. That is, in conveying a sheet by the pair of discharge rollers 130 toward the lower discharge tray 137 (first direction), the sheet conveyance velocity of the upper discharge roller 130*b* and that of the lower discharge roller 130*a* are the same. In contrast, in conveying a sheet bundle by the pair of discharge rollers 130 toward the rear-end stopper 150 (second direction), the conveyance velocity of the upper discharge roller 130*b* and that of the lower discharge roller 130*a* are different, thereby causing displacement to occur in the sheet conveying direction between sheets.

With the configuration according to the present embodiment, also in conveying a sheet bundle of two sheets by the pair of discharge rollers 130 by a specific amount after their rear ends move out of the pair of lower discharge rollers 128, the sheet conveyance amount of the upper discharge roller 130*b* and that of the lower discharge roller 130*a* can be different. This can provide advantageous effects of handling when a sheet bundle is conveyed in either of the first and second directions, so adhesion between sheets can be avoided.

With the first and second embodiments described above, a configuration in which the upper discharge roller 130*b* and the lower discharge roller 130*a* rotate in the same direction with different velocities is described. Alternatively, either one of the both rollers may be stopped or may be reversely rotated to have different velocities.

Third Embodiment

Next, a third embodiment of the present invention is described. The present embodiment differs from the first and second embodiments described above in that, whereas displacement is produced in sheets by a difference between the velocities of the rollers of the pair of discharge rollers 130 in the first and second embodiments, displacement is produced in sheets by a change in nip angle of the pair of discharge rollers 130 in the present embodiment. The sheet processing apparatus according to the present embodiment includes the independent bundle discharging drive motors M130*a* and M130*b* for the respective lower discharge roller 130*a* and upper discharge roller 130*b* and changes their conveyance velocities depending on the conveying direction, as in the case of the second embodiment.

Figure 17:
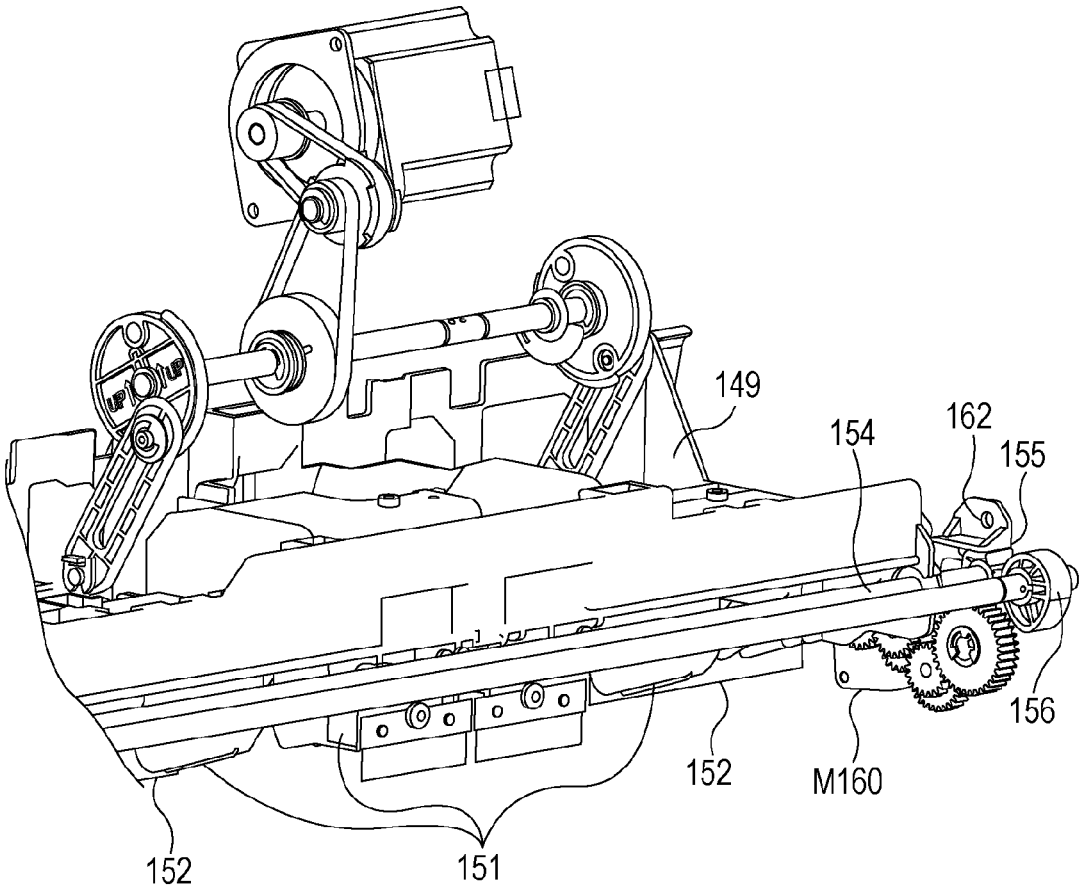
FIG. 17 is a diagram of a sheet processing apparatus according to a third embodiment.

FIG. 17 is an illustration of a movement mechanism of the oscillation guide 149 seen from the upstream side in the sheet conveying direction. As illustrated in FIG. 17, a contact member 155 is disposed on the same shaft as the support shaft 154 for the oscillation guide 149, and it is movable in a slider 162 depending on the rotation location of an eccentric cam 156 rotatable by a discharge-angle changing motor M160. The contact member 155 is continuously urged against the eccentric cam 156 by an urging spring (not illustrated) so as to be in contact with the eccentric cam 156. The contact member 155 is moved in the slider 162 together with the support shaft 154 depending on the rotation location of the eccentric cam 156, thereby moving the oscillation guide 149. The contact member 155, the eccentric cam 156, and the discharge-angle changing motor M160 form a changing portion.

The operation of the above changing portion moves the position of the roller nip formed by the upper discharge roller 130*b* and the lower discharge roller 130*a* along the outer surface of the lower discharge roller 130*a*, thus allowing the discharge angle of the pair of discharge rollers 130 to be changed. That is, the inclination of a line that connects the center of rotation of the upper discharge roller 130*b* and that of the lower discharge roller 130*a* can be changed. The first antistatic needle 152, the second antistatic needle 153, and the guiding guide 151 provided to the oscillation guide 149 integrally move together with movement of the oscillation guide 149. Accordingly, the positional relationship between the upper discharge roller 130*b* and each of the first antistatic needle 152 and the second antistatic needle 153 is not changed by movement of the oscillation guide 149.

Figure 18A:
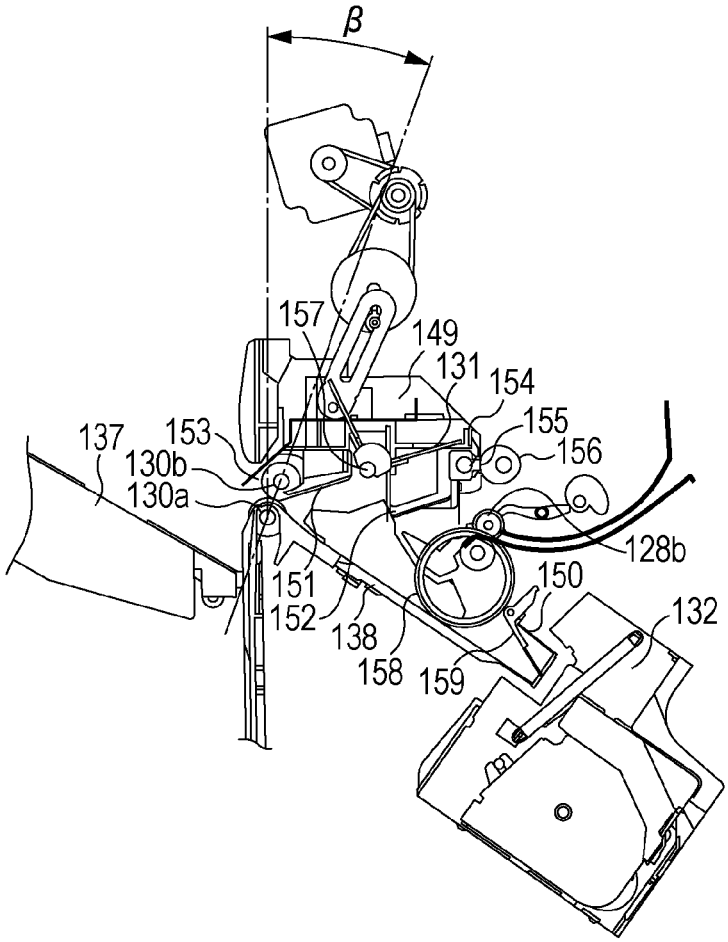
FIGS. 18A and 18B are illustrations for describing how a sheet flows and how the processing tray operates in staple sort mode according to the third embodiment.
Figure 18B:
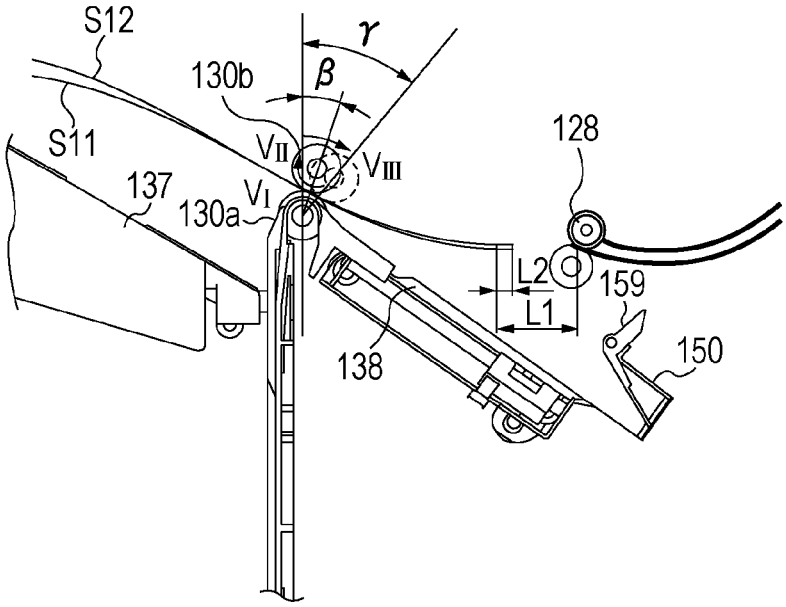

Next, how a sheet flows in staple sort mode according to the present embodiment is described using FIGS. 18A and 18B.

When a job in staple sort mode is selected, the oscillation guide 149 is moved by rotation of the eccentric cam 156 and sliding of the contact member 155 by the time the initial sheet in the first portion of the job is discharged from the image forming apparatus main body 600. An operation of changing the discharge angle to a wait position is executed after the oscillation guide 149 is pivoted upward about the support shaft 154 such that the upper discharge roller 130*b* and the lower discharge roller 130*a* are brought into a noncontact state.

As illustrated in FIG. 18A, when an operation of changing the discharge angle to the wait position is completed, the oscillation guide 149 is pivoted downward such that the upper discharge roller 130*b* and the lower discharge roller 130*a* come into contact with each other. That is, the pair of discharge rollers 130 waits in a state where the angle to a line that connects the center of rotation of the upper discharge roller 130*b* and that of the lower discharge roller 130*a* (discharge nip angle) is β and waits for discharge of the initial sheet of the job from the image forming apparatus main body 600.

Sheets subsequent to the sheet S11 that form the first portion discharged from the image forming apparatus main body 600 are successively conveyed while being shifted by the shift unit 108 by a specific amount in the width direction (to one side in front and back directions in FIG. 4) orthogonal to the sheet conveying direction. Then in the buffer path, the second sheet S12 is piled on the first sheet S11 in a state where the downstream end of the sheet S12 in the sheet conveying direction leads the downstream end of the sheet S11 in the sheet conveying direction by 10 mm, so-called in an imbricate state. The buffered sheets S11 and S12 are conveyed from the pair of lower discharge rollers 128 to the pair of discharge rollers 130 while being piled with an amount of displacement of 10 mm.

As illustrated in FIG. 18B, the two sheets S11 and S12 are conveyed by the pair of discharge rollers 130 by a specific distance after their upstream ends (rear ends) in the sheet conveying direction move out of the pair of lower discharge rollers 128. Specifically, the sheet S11 is conveyed with a conveyance velocity VI of 300 m/s of the lower discharge roller 130*a* and the sheet S12 is conveyed with a conveyance velocity VII of 300 m/s of the upper discharge roller 130*b* by a distance L1 of 30 mm for a time T of 100 ms.

During conveyance of the sheets S11 and S12 by the pair of discharge rollers 130, the oscillation guide 149 carries out an operation of changing the discharge angle by use of the changing portion. During the time T of 50 ms, the upper discharge roller 130*b* moves on the outer surface of the lower discharge roller 130*a* with a movement velocity VIII of 100 m/s by a distance L2 of 5 mm, and the discharge nip angle is changed from β to γ. The sheet S12 in contact with the upper discharge roller 130*b* in the sheet stuck is displaced toward the rear-end stopper 150 by 5 mm in response to the operation of changing the discharge angle executed by the oscillation guide 149, so the amount of displacement between the sheets S11 and S12 subjected to buffering is changed from 10 mm to 5 mm. Even if error in the conveying direction or an amount of displacement of 5 mm caused by the change of discharge angle is provided to an amount of displacement of 10 mm, the state in which the leading end of the upper sheet S12 leads the leading end of the lower sheet S11 is not reversed. Even if, during conveyance of sheets of coated paper having good surface nature or films piled by buffering to the processing tray 138, adhesion occurs between the sheets, advantageous effects of handling can be provided by causing the sheets to be displaced by 5 mm before the sheets comes into contact with the rear-end stopper 150.

In this way, during conveyance of piled sheets by the upper discharge roller 130*b* and the lower discharge roller 130*a*, the piled sheets can be displaced in the sheet conveying direction by a change in inclination of a line that connects the centers of rotations of both rollers. Removal of adhesion before alignment by the front-side and back-side alignment plates 340 and 341 and before the sheets come into contact with the rear-end stopper 150 enables the ends of the piled sheets to be easily aligned. As for the alignment in the sheet conveying direction, the sheets are directed toward the rear-end stopper 150 by inertial force present after separation of the upper discharge roller 130*b* and the lower discharge roller 130*a* and inclination of the stacking surface of the processing tray 138 while the state where the leading end of the upper sheet S12 leads the leading end of the lower sheet S11 is maintained. In alignment in the sheet conveying direction, the drawing paddles 131 and the belt roller 158 act on the upper sheet S12, the rear end of the lower sheet S11 is first abutted against the rear-end stopper 150, and the upper sheet S12 is then abutted, thus carrying out satisfactory alignment.

After that, as in the case of the first embodiment, sheets of the third and subsequent pages in the first portion are aligned and stacked, binding processing is performed as necessary, and the sheet bundle is discharged to the lower discharge tray 137.

Control of Discharge of Buffered Sheets

Figure 19:
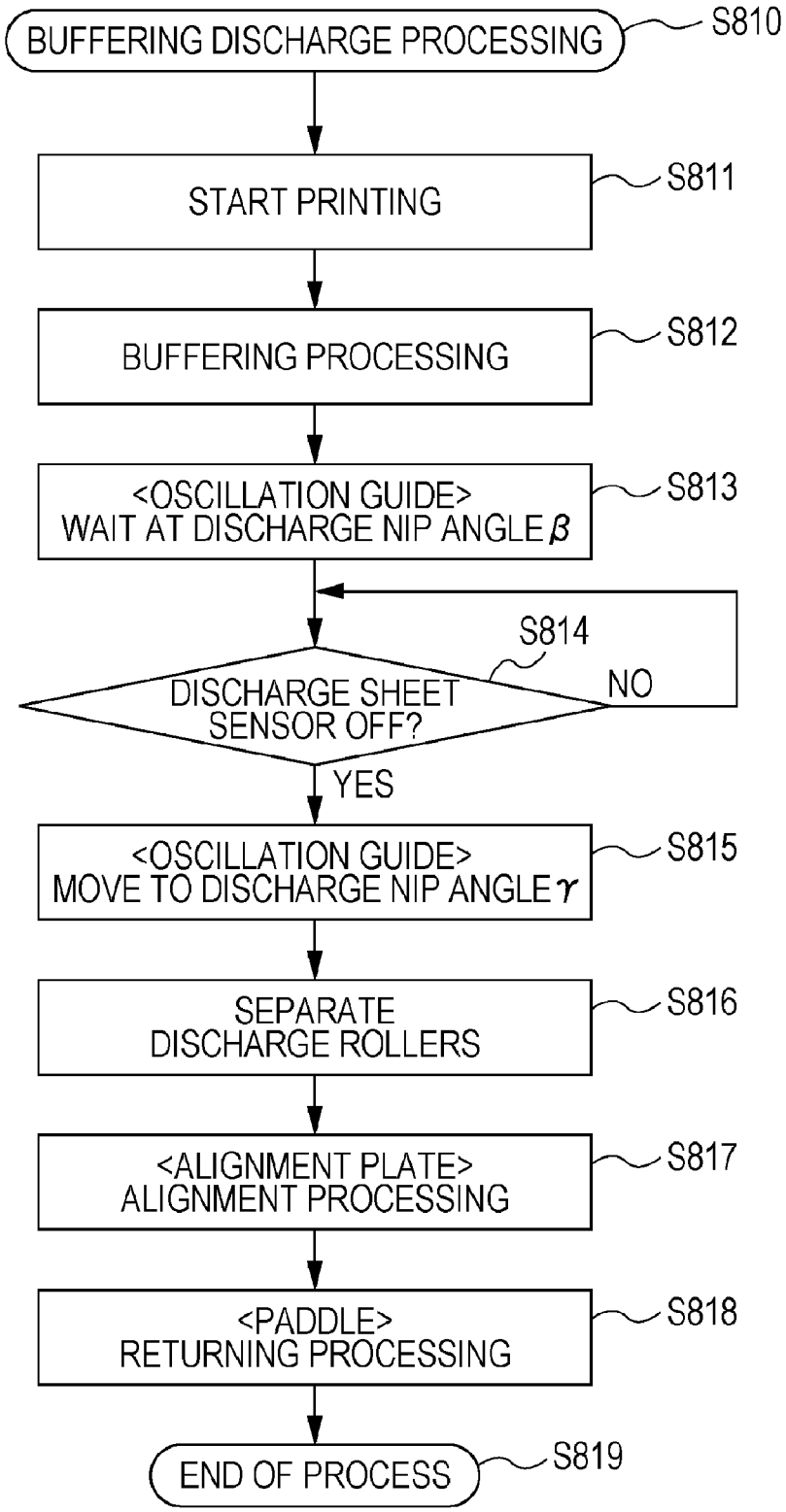
FIG. 19 is a flowchart of a finisher control section according to the third embodiment.
Figure 20:
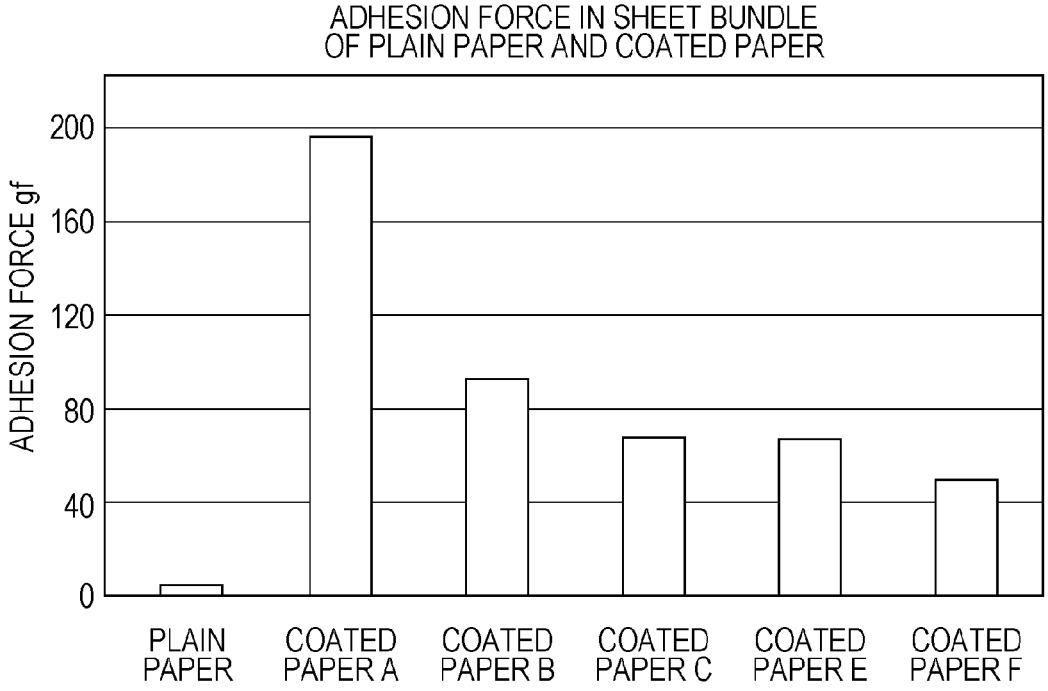
FIG. 20 illustrates adhesion forces of sheets.

FIG. 19 is a flowchart for describing control of discharge of buffered sheets according to the third embodiment. As illustrated in FIG. 19, when buffering discharge processing on the sheet S11 being the first sheet and the sheet S12 being the second sheet included in a sheet bundle is set (S810), printing from the image forming apparatus main body 600 is started (S811), and the buffering processing is performed (S812). During that time, the upper discharge roller 130*b* and the lower discharge roller 130*a* wait at the discharge nip angle β (S813), and discharging a sheet to the processing tray portion of the finisher 100 is started. When the sheets S11 and S12 pass through a discharge sheet detecting sensor 127 (FIG. 4) (YES in S814) and their rear ends move out of the pair of lower discharge rollers 128, the upper discharge roller 130*b* is moved to the position corresponding to the nip angle γ by the discharge-angle changing portion (S815). When the discharge of the sheets to the processing tray 138 is completed, the upper discharge roller 130*b* and the lower discharge roller 130*a* become separated (S816), and width alignment processing is performed by the front-side alignment plate 340 and the back-side alignment plate 341 (S817). When the alignment processing in the width direction on the sheets S11 and S12 is completed, paddle returning processing (S818) by the drawing paddles 131 is started. The rear ends of the sheets S11 and S12 come into contact with the rear-end stopper 150, and the processing is completed (S819).

For the present embodiment, the changing portion is provided to the upper discharge roller 130*b*. However, other configurations are also applicable. For example, the changing portion may be provided to the lower discharge roller 130*a*, and piled sheets can be displaced by a change in a contact position of the lower discharge roller 130*a* by the time reverse rotation of the pair of discharge rollers 130 is started.

Moreover, piled sheets can be displaced by a change in a contact position of either one of the upper and lower discharge rollers to a direction opposite to the sheet conveying direction while the piled two sheets are conveyed toward the rear-end stopper 150 by reverse driving of the pair of discharge rollers 130.

Moreover, piled sheets can be displaced by a change in a contact position of either one of the upper and lower discharge rollers to the same direction as the sheet conveying direction by the time driving of the pair of discharge rollers 130 is reversed.

Furthermore, piled sheets can be displaced by a change in a contact position of either one of the upper and lower discharge rollers to the same direction as the sheet conveying direction while driving of the pair of discharge rollers 130 is reversed and the sheets are conveyed toward the rear-end stopper 150.

For the present embodiment, a configuration in which the pair of discharge rollers can be independently driven is described. However, as long as at least one roller moving along the outer surface of the other roller is driven by the bundle discharging drive motor, displacement can be produced between piled sheets in the sheet conveying direction.

As in the present invention, in conveying a plurality of sheets in a piled state toward a regulation member against which a sheet is abutted to regulates the sheet, displacement caused to occur in a sheet conveying direction between the piled sheets by a pair of conveying rotary members can remove adhesion of the sheets and achieve satisfactory alignment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of International Application No. PCT/JP2009/070572, filed Dec. 8, 2009, and No. PCT/JP2010/052560, filed Feb. 19, 2010, which are hereby incorporated by reference herein in their entirety.

What is claimed is:

1. A sheet processing apparatus comprising:

a conveying portion, having a pair of conveying rotary members, capable of conveying a plurality of sheets in a piled state;

a stacking tray on which sheets, conveyed by the conveying portion are stacked;

a regulation member against which piled sheets are abutted to regulate the sheet conveyed to the stacking tray, a changing portion which changes inclination of a line that connects centers of rotations of the pair of conveying rotary members; and a control portion which controls the changing portion, the control portion controlling the changing portion so that displacement of the piled sheets in a sheet conveying direction occurs by changing the inclination of the line connecting the centers of the rotations before the piled sheets are abutted against the regulation member.

2. The sheet processing apparatus according to claim 1, wherein the changing portion displaces the piled sheets by moving the first rotary member of the pair of conveying rotary members along an outer surface of the second rotary member.

3. The sheet processing apparatus according to claim 1, wherein the pair of conveying rotary members are capable of rotating in forward and reverse directions and convey the piled sheets onto the stacking tray by forward rotation, toward the regulation member by reverse rotation.

* * * * *